US009383157B2

(12) United States Patent
Folk

(10) Patent No.: US 9,383,157 B2
(45) Date of Patent: Jul. 5, 2016

(54) ARMORER'S BLOCK

(71) Applicant: Apex Tactical Specialities, Inc., Los Osos, CA (US)

(72) Inventor: Scott Folk, Los Osos, CA (US)

(73) Assignee: Apex Tactical Specialties, Inc., Los Osos, CA (US)

( * ) Notice: Subject to any disclaimer, the term of this patent is extended or adjusted under 35 U.S.C. 154(b) by 286 days.

(21) Appl. No.: 14/103,828

(22) Filed: Dec. 11, 2013

(65) Prior Publication Data

US 2015/0159972 A1 Jun. 11, 2015

(51) Int. Cl.

| | |
|---|---|
| ***F41A 23/00*** | (2006.01) |
| ***F41A 23/18*** | (2006.01) |
| ***F41A 35/00*** | (2006.01) |

(52) U.S. Cl.

CPC ..... *F41A 23/18* (2013.01); *F41A 35/00* (2013.01); *Y10T 29/49817* (2015.01); *Y10T 29/49998* (2015.01)

(58) Field of Classification Search

CPC ... F41A 23/18; F41A 35/00; Y10T 29/49817; Y10T 29/49998

USPC ..... 89/37.04; 73/167

See application file for complete search history.

(56) References Cited

U.S. PATENT DOCUMENTS

| | | | |
|---|---|---|---|
| 744,559 | A | 11/1903 | Kendrick |
| 4,438,913 | A | 3/1984 | Hylla |
| 5,661,919 | A | 9/1997 | Pryor |
| 6,105,951 | A | 8/2000 | Shibata |
| 6,497,025 | B1 | 12/2002 | Bohannan et al. |
| 7,584,690 | B2 | 9/2009 | Cauley |
| 2012/0005937 | A1 | 1/2012 | Milino |
| 2012/0255212 | A1 | 10/2012 | Werner |
| 2012/0255979 | A1 | 10/2012 | Sitz |

*Primary Examiner* — Samir Abdosh

(74) *Attorney, Agent, or Firm* — Fitch Even Tabin & Flannery LLP

(57) ABSTRACT

A firearm support apparatus for supporting a firearm in a generally horizontal orientation. The firearm support apparatus includes a support plate configured to horizontally support the firearm on both a top face and a bottom face 200 of the support plate. The support plate additionally includes a plurality of projections for providing horizontal restraint to the firearm, and a plurality of cutouts configured to provide clearance and access to portions of the firearm. The firearm support apparatus includes two moveable bosses for frictionally securing the firearm to the firearm support apparatus. The firearm support apparatus includes a striker holder for supporting a striker of the firearm in a generally vertical orientation, and a trigger holder for supporting a trigger of the firearm in a generally horizontal orientation.

19 Claims, 11 Drawing Sheets

ARMORER'S BLOCK

BACKGROUND OF THE INVENTION

1. Field of the Invention

The present invention relates generally to firearm holding devices, and more specifically to firearm holding devices for cleaning and maintaining a firearm.

2. Discussion of the Related Art

Traditionally, a firearm such as a shotgun or handgun is either handheld during maintenance or cleaning, or held securely by a standard metal machinist vise or shop vise. However, machinist or shop vises are not designed for firearm restraint and may, for example, damage the finish of the firearm or restrain the firearm in a position inconvenient for the user.

Handgun holding devices found in the prior art commonly support the handgun in a position where the plane of the gun is vertical, i.e. either in a firing position or with the barrel oriented in a vertical direction.

Adjustable portions of the handgun holding device typically allow for the firearm to be placed in the holding device and then secured. Other adjustable portions may allow for various firearm shapes and sizes to be secured by the same holding device.

Firearm holding devices may also support the firearm in a horizontal position so that firearm pins are in a vertical position and the handgun is supported when the pins are punched or hammered out. While horizontal holding devices typically provide support for the entire firearm, because the holding device must be designed to support the varying profile of the firearm, the ability of the firearm holding device to support varying shapes and sizes is limited.

Another characteristic found in firearm holding devices is one or more areas for holding portions of the firearm removed during maintenance, for example, the trigger.

SUMMARY OF THE INVENTION

In one embodiment, the invention can be characterized as a firearm support apparatus for securing a firearm, comprising: a support plate including a top face configured to conformingly receive the firearm in a flat position, the support plate including a barrel edge proximate to a barrel of the firearm when the firearm is supported by the support plate, the support plate further including a first boss cutout, the first boss cutout configured in a generally oblong shape, and located proximate to a back strap of the firearm when the firearm is supported in the flat position, the support plate further including a second boss cutout, the second boss cutout configured in a generally oblong shape, the second boss cutout located proximate to a front strap of the firearm when the firearm is supported in the flat position; at least four bottom legs coupled to a bottom face of the support plate; a first moveable boss comprising a first top cylinder, the first top cylinder including a first top circular hole parallel to a cylindrical axis of the first top cylinder, and a first top hexagonal indentation in an end of the first top cylinder distal to the support plate, the first top cylinder having an outer diameter greater than a width of the first boss cutout, and the first top cylinder cylindrical axis oriented generally perpendicular to the top face, a first bottom cylinder including a first bottom circular hole parallel to a cylindrical axis of the first bottom cylinder, and a first bottom hexagonal indentation in an end of the first bottom cylinder distal to the support plate, the first bottom cylinder having an outer diameter greater than the width of the first boss cutout, and the first bottom cylinder cylindrical axis oriented generally perpendicular to the bottom face, a first bolt comprising a first head and a first threaded shaft, whereby the first bolt couples the first top cylinder to the first bottom cylinder by the first head fitting snugly into the first top hexagonal indentation and the first threaded shaft extending through the first top circular hole, through the first boss cutout, and through the first bottom circular hole, a first nut fitting snugly into the first bottom hexagonal indentation and threadably coupled to the first threaded shaft, whereby the support plate is sandwiched between the first top cylinder and the first bottom cylinder and the first threaded shaft is encircled by the first boss cutout, whereby the first moveable boss slides relative to the top face and the bottom face by loosening the first nut and sliding the first moveable boss along the top face and the bottom face, and whereby the first moveable boss is frictionally coupled to the support plate by tightening the first nut on the first threaded shaft, and whereby the first moveable boss positionally engages the firearm when the firearm is supported in the flat position by the support plate and the first moveable boss is juxtaposed with a rear curved portion of the firearm, the rear curved portion proximate to the barrel; a second moveable boss comprising a second top cylinder, the second top cylinder including a second top circular hole parallel to a cylindrical axis of the second top cylinder, and a second top hexagonal indentation in an end of the second top cylinder distal to the support plate, the second top cylinder having an outer diameter greater than a width of the second boss cutout, and the second top cylinder cylindrical axis oriented generally perpendicular to the top face, a second bottom cylinder including a second bottom circular hole parallel to a cylindrical axis of the second bottom cylinder, and a second bottom hexagonal indentation in the end of the first bottom cylinder distal to the support plate, the second bottom cylinder having an outer diameter greater than the width of the second boss cutout, and a second bottom cylinder cylindrical axis oriented generally perpendicular to the bottom face, a second bolt comprising a second head and a second threaded shaft, whereby the second bolt couples the second top cylinder to the second bottom cylinder by the second head fitting snugly into the second top cylinder hexagonal indentation and the second threaded shaft extending through the second top circular hole, through the second boss cutout, and through the second bottom circular hole, a second nut, the second nut fitting snugly into the second bottom hexagonal indentation and being threadably coupled to the second threaded shaft, whereby the support plate is sandwiched between the second top cylinder and the second bottom cylinder and the second threaded shaft is encircled by the second boss cutout, whereby the second moveable boss slides relative to the top face and the bottom face by loosening the second nut and sliding the second moveable boss along the top face and the bottom face, and whereby the second moveable boss is frictionally coupled to the support plate by tightening the second nut on the second threaded shaft; and whereby the second moveable boss positionally engages the firearm when the firearm is supported in the flat position by the support plate and the second moveable boss is juxtaposed with a front curved portion of the firearm, the front curved portion formed by an intersection of a trigger of the firearm and the front strap of the firearm; at least one top frame projection coupled to the top face, the at least one top frame projection located proximate to the barrel edge, whereby the at least one top frame projection is juxtaposed with a top side of a firearm barrel, whereby a combination of the first moveable boss, the second moveable boss, and the at least one top frame projection results in horizontal restraint of the firearm, and whereby the horizontal restraint is removed by loosening at least one moveable boss.

In another embodiment, the invention can be characterized as a method of securing a firearm to a firearm support apparatus, comprising the steps of: laying the firearm in a flat position on an upward-facing surface of a support plate of the firearm support apparatus such that an at least one top frame projection coupled to the upward-facing surface is proximate to a top of a barrel of the firearm, a first moveable boss coupled to the support plate is proximate to a front strap of the firearm, and a second moveable boss coupled to the support plate is proximate to a back strap of the firearm; sliding the first moveable boss along a top face such that the first moveable boss is juxtaposed with the firearm; securing the first moveable boss to the support plate in the juxtaposed position; sliding the second moveable boss along the top face such that the second moveable boss is juxtaposed with the firearm; securing the second moveable boss to the support plate in the juxtaposed position.

BRIEF DESCRIPTION OF THE DRAWINGS

The above and other aspects, features and advantages of several embodiments of the present invention will be more apparent from the following more particular description thereof, presented in conjunction with the following drawings.

Figure 1:
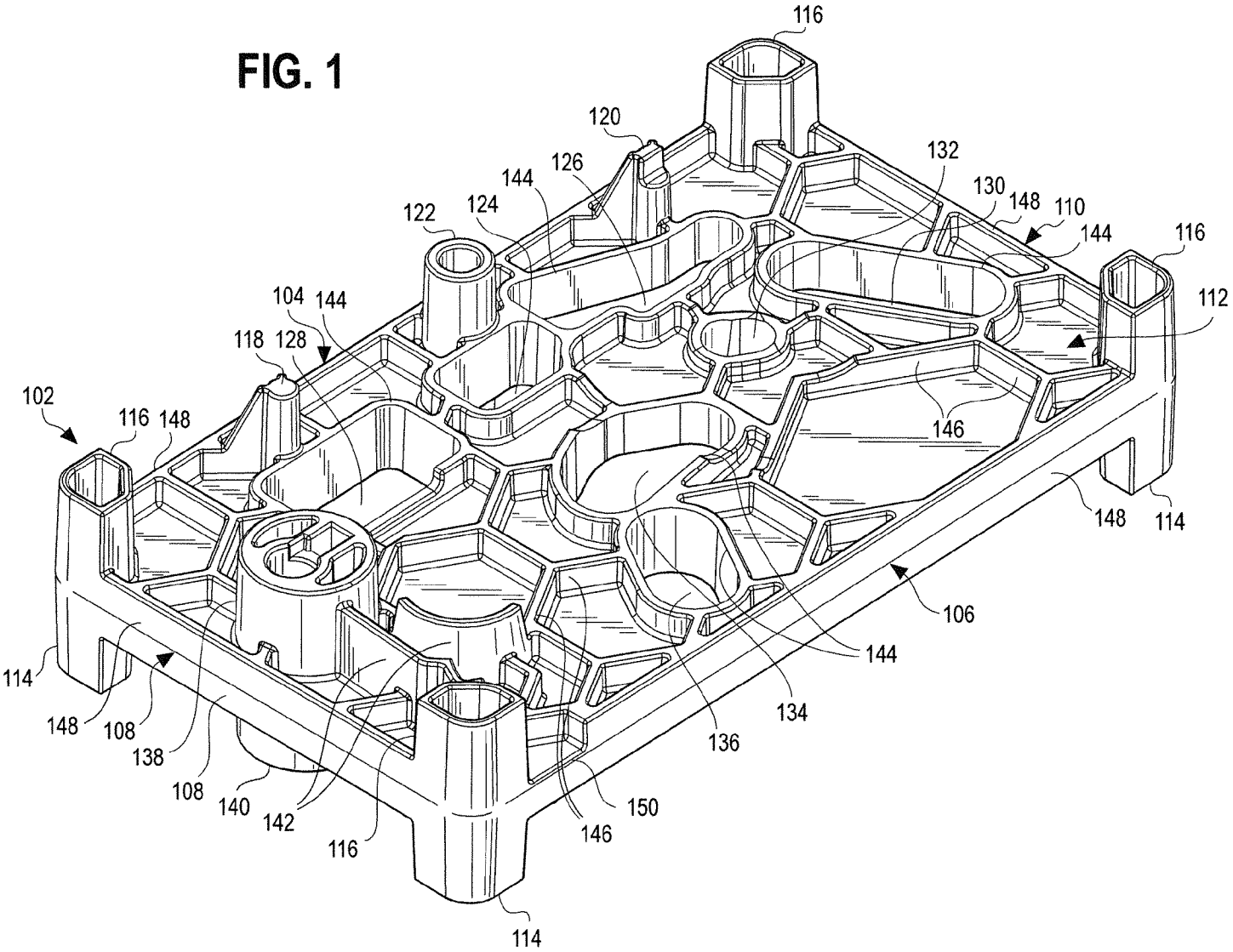
FIG. 1 is a perspective view of a support plate of a firearm support apparatus with a top face of the support plate facing upwards

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The following description is not to be taken in a limiting sense, but is made merely for the purpose of describing the general principles of exemplary embodiments. The scope of the invention should be determined with reference to the claims.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Referring first to FIG. 1, a perspective view of a firearm support apparatus 100 according to an embodiment of the present invention is shown. Shown are a support plate 102, a barrel edge 104, a magazine edge 106, a front edge 108, a rear edge 110, a top face 112, a plurality of bottom legs 114, a plurality of top legs 116, a front top frame projection 118, a rear top frame projection 120, a center top frame projection 122, a slide lock lever cutout 124, a thumb safety cutout 126, a frame takedown lever cutout 128, a first boss cutout 130, a sear housing pin cutout 132, a magazine release cutout 134, a second boss cutout 136, a top striker holder 138, a bottom striker holder 140, a top trigger holder 142, a plurality of cutout perimeter walls 144 144, a plurality of honeycomb walls 146, a plurality of edge perimeter walls 148, and a magazine edge notch 150.

The firearm support apparatus 100 includes the support plate 102. In the preferred embodiment, the support plate 102 is oriented with a plane of the support plate 102 generally parallel to a plane of an external support, for example, a table or workbench. The support plate 102 is generally rectangular prism-shaped, with length and width dimensions parallel to the plane of the external support, and a thickness dimension perpendicular to the plane of the external support. In the preferred embodiment, the length×width×thickness dimensions are approximately 7"×4"×1.525". Each support plate 102 corner is rounded in the direction perpendicular to the plane of the external support, to a diameter of approximately ¼".

In the preferred embodiment the support plate 102 comprises high-density polymer plastic, although other materials suitable for providing adequate support for a firearm 1300 during maintenance tasks may also be used.

The support plate 102 includes the top face 112 facing upwards in FIG. 1, and a bottom face facing downwards in FIG. 1 (not shown).

The support plate 102 includes four edges perpendicular to the external support: the barrel edge 104, the magazine edge 106, the front edge 108, and the rear edge 110. When the firearm 1300 is coupled to the firearm support apparatus 100 (as shown below in FIGS. 9, 10), the barrel edge 104 is proximate to a barrel 1302 of the firearm 1300, the magazine edge 106 is proximate to a bottom end of a magazine 1306 of the firearm 1300, the front edge 108 is proximate to an end of the barrel 1302, and the rear edge 110 is proximate to a back strap 1308 of the firearm 1300.

In the preferred embodiment, the support plate 102 is generally symmetric with respect to a horizontal centerline of the support plate 102. While, for identification and clarification purposes, the FIG. 1 upward-facing face of the support plate 102 is referred to as the "top" face and a downward-facing face of the support plate 102 is referred to as the "bottom" face, those of ordinary skill in the art will note that the support plate 102 may also be utilized in the orientation with the "top" face facing downward and the "bottom" face facing upward, as shown below in FIG. 2.

Four bottom legs 114 are coupled to the bottom face 200 of the support plate 102. Each bottom leg 114 is located proximate to one corner of the support plate 102. In the preferred embodiment, the bottom legs 114 are comprised of the same material as and integrally coupled to the support plate 102. The bottom legs 114 are generally tubular, with an approximate wall thickness of 1/16". The bottom legs 114 include a perimeter shape configured to align with and form a continuous surface with the proximate rounded corner of the support plate 102

The top legs 116 extend upward from the top face 112, and in all other aspects are configured similarly to the bottom legs 114.

The support plate 102 further includes three top frame projections extending upward from the top face 112: the front top frame projection 118, the center top frame projection 122 and the rear top frame projection 120. The front top frame projection 118 and rear top frame projection 120 are located proximate to the barrel edge 104 and are spaced at approximate ⅓ points along the barrel edge 104, with the front top frame projection 118 located proximate to the front edge 108, and the rear top frame projection 120 located proximate to the rear edge 110. The front top frame projection 118 and the rear top frame projection 120 are integrally coupled to the support plate 102 and extent upward in a generally perpendicular direction from the top face 112. The height of the front top frame projection 118 and the rear top frame projection 120 match the height of the top legs 116. The front top frame projection 118 and the rear top frame projection 120 are described further below in FIGS. 9, 10.

The center top frame projection 122 extends outward from the top face 112 at a support plate 102 location approximately equidistant from the front edge 108 and the rear edge 110, and located between the slide lock lever cutout 124 and the barrel edge 104. The center top frame projection 122 is pipe-shaped and the height of the center top frame projection 122 matches the height of the top legs 116.

The support plate 102 further includes a plurality of interior cutouts 124, 126, 130, 132, 134, 136. The interior cutouts 124, 126, 130, 132, 134, 136 extend through the entire support plate 102 thickness.

The thumb safety cutout 126 is located proximate to the barrel edge 104 and the rear edge 110. The thumb safety cutout 126 is asymmetrically shaped, as it is configured to accommodate a thumb safety 1900 of the firearm 1300 in either a safe position 1902 or a fire position 1904. The thumb safety cutout 126 is also configured to provide access to a sear housing block coil pin proximate to the thumb safety 1900. In the present embodiment, the thumb safety cutout 126 is a modified right triangle shape, forming a right angle parallel to the front edge 108 and the magazine edge 106, and the hypotenuse sloping from proximate to the barrel edge 104 to proximate to the rear edge 110.

Proximate to the thumb safety cutout 126 on a front edge 108 side of the thumb safety cutout 126 is the slide lock lever cutout 124. The slide lock lever cutout 124 is generally rectangular-shaped with rounded corners. The slide lock lever cutout 124 is located proximate to the barrel edge 104 and to an edge of the thumb safety cutout 126 proximate to the front edge 108.

Between the slide lock lever cutout 124 and the front edge 108 is the frame takedown lever cutout 128. The frame takedown lever cutout 128 is generally rectangular-shaped with rounded corners. The frame takedown lever cutout 128 is located proximate to the barrel edge 104 and the front edge 108 in a location to align with a slide lock lever of the firearm 1300 when the firearm 1300 is coupled to the firearm support apparatus 100.

The support plate 102 further includes the first boss cutout 130. The first boss cutout 130 is located proximate to the rear edge 110 and approximately equidistant from the barrel edge 104 and the magazine edge 106. The first boss cutout 130 is oblong in shape, with an edge proximate to the magazine edge 106 angled towards a corner of the rear edge 110 and the magazine edge 106. The first boss cutout 130 is configured to receive a first moveable boss 300, as described below in FIG. 3.

The support plate 102 further includes the sear housing pin cutout 132, located proximate to an edge of the first boss cutout 130 proximate to the front edge 108 and an edge of the slide lock lever cutout 124 proximate to the magazine edge 106 in the direction of the front edge 108. The sear housing pin cutout 132 is oblong in shape, and configured to provide access to a sear housing pin 1400 of the firearm 1300 when the firearm 1300 is coupled to the firearm support apparatus 100.

The magazine release cutout 134 is located proximate to the sear housing pin cutout 132, in a direction towards the front edge 108. The magazine release cutout 134 is an approximately triangular shape with rounded corners, and configured to accommodate a magazine release 1404 of the firearm 1300 when the firearm 1300 is coupled to the firearm support apparatus 100.

The second boss cutout 136 is generally located between the magazine release cutout 134 and the magazine edge 106. The second boss cutout 136 is oblong in shape, and configured to receive a second moveable boss 302, as described further below in FIG. 3. An edge of the second boss cutout 136 proximate to the magazine edge 106 is angled towards a corner of the front edge 108 and the magazine edge 106.

The top striker holder 138 is located proximate to the front edge 108 approximately midway between the barrel edge 104 and the magazine edge 106. The top striker holder 138 is integrally coupled to the support plate 102 and extends upward in a generally perpendicular direction to match the height of the top legs 116. The top striker holder 138 is described further below in FIG. 11.

The bottom striker holder 140 is described below in FIGS. 2, 12.

The top trigger holder 142 includes a front top trigger wall 1600 and a rear top trigger wall 1602, and is described below in FIG. 16. A first trigger hole 210 and a second trigger hole 212 are located in the support plate 102 between the front top trigger wall 1600 and the rear top trigger wall 1602 and are described further below in FIG. 16.

Additionally, a plurality of cutout perimeter walls 144, honeycomb walls 146, and edge perimeter walls 148 are shown on the support plate 102. The cutout perimeter walls 144 are continuously coupled to and are integral to the support plate 102, and extend outward past the top face 112 and the bottom face 200 at the perimeter of the cutouts, at all cutout 124, 126, 128, 130, 132, 134, 136 locations. Heights of the cutout perimeter walls 144 vary, with the typical height of the cutout perimeter walls 144 approximately 3/16".

The honeycomb walls 146 are also continuously coupled to and are integral to the support plate 102. The honeycomb walls 146 project upward from the support plate 102, with the honeycomb walls 146 oriented approximately perpendicular to the plane of the support plate 102. The honeycomb walls 146 project approximately 3/16" from the face of the support plate 102. The honeycomb walls 146 are configured to form a general honeycomb pattern on the top face 112.

The edge perimeter walls 148 extend outward from the top face 112 and the bottom face 200 at the front edge 108, the rear edge 110, the barrel edge 104 and the magazine edge 106. The edge perimeter walls 148 project approximately 3/16" from the face of the support plate 102.

The edge perimeter wall 148 at the magazine edge 106 includes the magazine edge notch 150 in the magazine edge 106 edge perimeter wall 148 proximate to the top face 112. The magazine edge notch 150 extends to the top face 112 of the support plate 102. The magazine edge notch 150 extends approximately 9/16" along the length of the magazine edge 106 towards the rear edge 110, starting from the edge of the top leg 116 distal to the front edge 108.

With the exception of the cutout perimeter walls 144 surrounding the boss cutouts 130, 136, and the magazine edge notch 150, the cutout perimeter walls 144 and honeycomb walls 146 vary in height to match the contours of an exterior surface of the firearm 1300. The cutout perimeter walls 144 of the boss cutouts 130, 136 are typically of uniform height in order to provide a sliding surface for the moveable bosses 300, 302 (as described further below in FIGS. 3, 4, 8), but portions of the cutout perimeter walls 144 of the moveable bosses 300, 302 may vary from the typical height if those portion are not required for the sliding surface.

Referring again to FIG. 1, the support plate 102 is configured to support and secure the firearm 1300 to the firearm support apparatus 100 in a horizontal position in conjunction with the plurality of moveable bosses 300, 302, as shown below in FIGS. 13, 14. Securing the firearm 1300 in the horizontal position provides improved access to the firearm 1300 during assembly, disassembly and maintenance. Each face 112, 200 of the support plate 102 is configured to support the firearm 1300 such that each face 112, 200 of the firearm 1300 may be accessible when coupled to the firearm support apparatus 100. In the present embodiment, the top face 112 and the bottom face 200 are each configured to support the same firearm 1300 body shape, but it should be noted that the top face 112 and the bottom face 200 may alternately be configured to accommodate different firearm 1300 body shapes.

The support plate 102, the legs 114, 116, the walls 144, 146, 148, the projections 118, 120, 122, and the holders 138, 140, 142, 208 are comprised of high-density polymer plastic. The high-density polymer plastic provides suitable strength and rigidity for securing the firearm 1300 to the firearm support apparatus 100 and for supporting the firearm 1300 during impact maintenance tasks, such as hammering out of at least one firearm 1300 pin. In the present embodiment, the support plate 102 and all components integral to the support plate 102 are formed by injection molding, but it should be noted that additional methods of forming the support plate 102 and integral components, for example machining, may be used.

The plurality of top legs 116 and bottom legs 114 are coupled to the support plate 102. When the top face 112 faces upwards and the firearm 1300 is placed on the support plate 102, the bottom legs 114 provide clearance between the firearm 1300 and the external support to allow for at least one firearm 1300 pin to fall to the external support when pushed from above. Similarly, when the bottom face 200 faces upwards, the top legs 116 provide firearm 1300 pin clearance when the firearm 1300 is coupled to the bottom face 200.

The legs 114, 116 are hollow, as described above, in order to provide sufficient strength to support the firearm 1300 during maintenance while using a minimum of material.

The support plate 102 includes the front top frame projection 118 and the rear top frame projection 120 near the barrel edge 104 of the support plate 102. The front top frame projection 118 and the rear top frame projection 120 are juxtaposed with the barrel 1302 of the firearm 1300 and restrain the firearm 1300 from moving in the direction of the barrel edge 104 when the firearm 1300 is supported by the top face 112 of the support plate 102. The front top frame projection 118 and the rear top frame projection 120 also provide rigidity and support to the firearm support apparatus 100 when the bottom face 200 is upwards.

The center top frame projection 122 provides additional rigidity and support to the support plate 102 during firearm 1300 maintenance when the bottom face 200 is facing upwards.

The thumb safety 1900 projects from a side of the firearm 1300. The thumb safety cutout 126 provides the necessary clearance around the thumb safety 1900 so that the firearm 1300 may be supported in the horizontal position on the firearm support apparatus 100. The thumb safety cutout 126 also allows for access to the thumb safety 1900 from the opposite side of the firearm support apparatus 100, i.e. when the firearm 1300 is coupled to the top face 112 and the thumb safety 1900 is proximate to the top face 112, the thumb safety 1900 is accessible through the thumb safety cutout 126 when the firearm support apparatus 100 is rotated such that the bottom face 200 faces upwards.

The thumb safety cutout 126 is shaped to provide clearance for the thumb safety 1900 when the thumb safety 1900 is in both a fire position 1904 and a safe position 1902, as shown below in FIG. 19. The thumb safety cutout 126 is also shaped to provide access to at least one firearm 1300 pin proximate to the thumb safety 1900.

Similarly to the thumb safety cutout 126, the slide lock lever cutout 124 is configured to provide clearance for a slide lock lever of the firearm 1300 when the firearm 1300 is coupled to the firearm support apparatus.

The first boss cutout 130 is located proximate to the rear edge 110 of the support plate 102 and provides a first attachment and sliding adjustment area for the first moveable boss 300. The second boss cutout 136, located proximate to a midpoint of the magazine edge 106, provides a second attachment and sliding adjustment area for the second moveable boss 302. The first and second moveable bosses 300, 302 are used to provide demountable coupling of the firearm 1300 to the firearm support apparatus 100 and also to allow for coupling of different sizes and shapes of firearms 1300. The attachment and adjustment of the first and second moveable bosses 300, 302 are shown below in FIGS. 3-4, 13.

The sear housing pin cutout 132 located proximate to the first boss cutout 130 and the thumb safety cutout 126 is configured to provide clearance and access for the sear housing pin 1400 of the firearm 1300 to be removed from the firearm 1300 when the firearm 1300 is coupled to the firearm support apparatus 100.

The magazine release cutout 134 proximate to the second moveable boss 302 is configured to provides access allowing the magazine release 1404 of the firearm 1300 when the firearm 1300 is coupled to the support plate 102 and the magazine release 1404 of the firearm 1300 is proximate to the top face 112 of the support plate 102.

The top striker holder 138 supports a striker 1500 of the firearm 1300 in a generally vertical position, when the striker 1500 has been removed from the firearm 1300. In addition, the top striker holder 138 is configured and located such that a portion of a curved exterior surface of the top striker holder 138 is juxtaposed with a concave intersection of the barrel 1302 and a firearm trigger guard 1304 when the firearm 1300 is coupled to the firearm support apparatus 100, providing additional horizontal restraint of the firearm 1300. In addition, the height of the top striker holder 138 matches the height of the top legs 116 such that the top striker holder 138 provides additional support and rigidity to the support plate 102 when the bottom face 200 is facing upwards.

In the present embodiment, the top striker holder 138 is configured for the striker of a .45 ACP pistol, but it will be readily apparent to those skilled in the art that the top striker holder 138 may be modified for other makes and models of firearms. The use of the top striker holder 138 is described further below in FIG. 15.

The top trigger holder 142 includes the front top trigger wall 1600 and the rear top trigger wall 1602 for demountably coupling a trigger 1800 of the firearm 1300 to the support plate 102, in a generally horizontal position, when the trigger 1800 is removed during disassembly or maintenance. A first trigger hole 210 and a second trigger hole 212 included in the support plate 102 (not shown) are located between the front top trigger wall 1600 and the rear top trigger wall 1602, configured to permit removal of a first trigger pin 1802 and a second trigger pin 1804 from the trigger 1800 when the trigger 1800 is coupled to the firearm support apparatus 100. The top trigger holder 142 and the trigger holes 210, 212 are described further below in FIG. 12.

The plurality of cutout perimeter walls 144, edge perimeter walls 148, and honeycomb walls 146 provide additional stiffness and rigidity to the support plate 102. Those skilled in the art will note that in lieu of a thinner support plate 102 including cutout perimeter walls 144, honeycomb walls 146, and edge perimeter walls 148, a thicker support plate 102 would also be suitable. The cutout perimeter walls 144 and honeycomb walls 146 are shorter than the typical wall height where required to provide support for varying surface contours of the firearm 1300.

The magazine edge 106 includes the magazine edge notch 150. The magazine edge notch 150 provides clearance for a trigger bar 1806 when the trigger bar is Referring next to FIG. 2, a perspective view of the firearm support apparatus 100, with the bottom face 200 facing upwards, is shown according to an embodiment of the present invention. Shown are the support plate 102, the barrel edge 104, the magazine edge 106, the front edge 108, the rear edge 110, the plurality of bottom legs 114, the plurality of top legs 116, the slide lock lever cutout 124, the thumb safety cutout 126, the frame takedown lever cutout 128, the first boss cutout 130, the sear housing pin cutout 132, the magazine release cutout 134, the second boss cutout 136, the bottom striker holder 140, the plurality of cutout perimeter walls 144, the plurality of honeycomb walls 146, the plurality of edge perimeter walls 148, the magazine edge notch 150, the bottom face 200, a front bottom frame projection 202, a rear bottom frame projection 204, a center bottom frame projection 206, a bottom trigger holder 208, a first trigger hole 210, and a second trigger hole 212.

Figure 2:
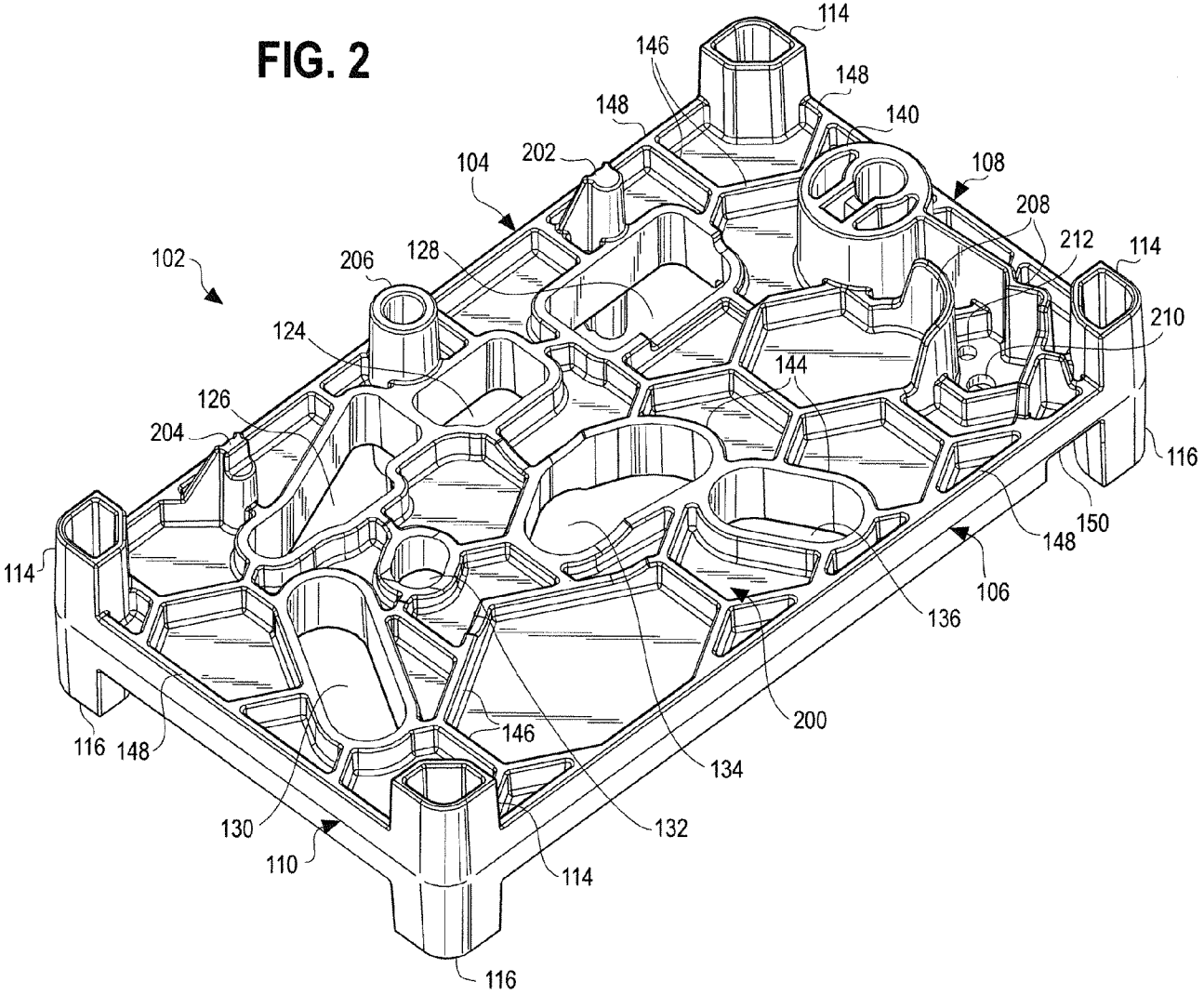
FIG. 2 is a perspective view of the support plate of the firearm support apparatus with a bottom face of the support plate facing upwards.

As shown in FIG. 2, the support plate 102 is oriented so that the top face 112 faces downward and the bottom face 200 faces upward. The support plate 102 is generally symmetrical about the horizontal centerline of the support plate 102. Thus, the features and cutouts as described in FIG. 1 are also present in FIG. 2 in a mirrored configuration. Exceptions to support plate 102 symmetry include the bottom striker holder 140 (as described below in FIG. 12), the bottom trigger holder 208 (as described below in FIG. 17), and the presence of the magazine edge notch 150. The symmetry of the support plate 102 allows the firearm support apparatus 100 to be used with either the top face 112 facing upward or the bottom face 200 facing upwards. Additionally, variations in the geometry of the bottom striker holder 140 and the bottom trigger holder 208 allow for multiple types of triggers and strikers to be supported by the same firearm support apparatus 100.

In addition, the symmetry allows for the firearm 1300 to be restrained on the support plate 102 with one face facing upwards, and the firearm support apparatus 100 then rotated so that the opposite face is facing upwards. This allows some of the cutouts, for example the slide lock lever cutout 124 and the magazine release cutout 134, to provide access to portions of the firearm 1300 for assembly, maintenance or disassembly.

Figure 3:
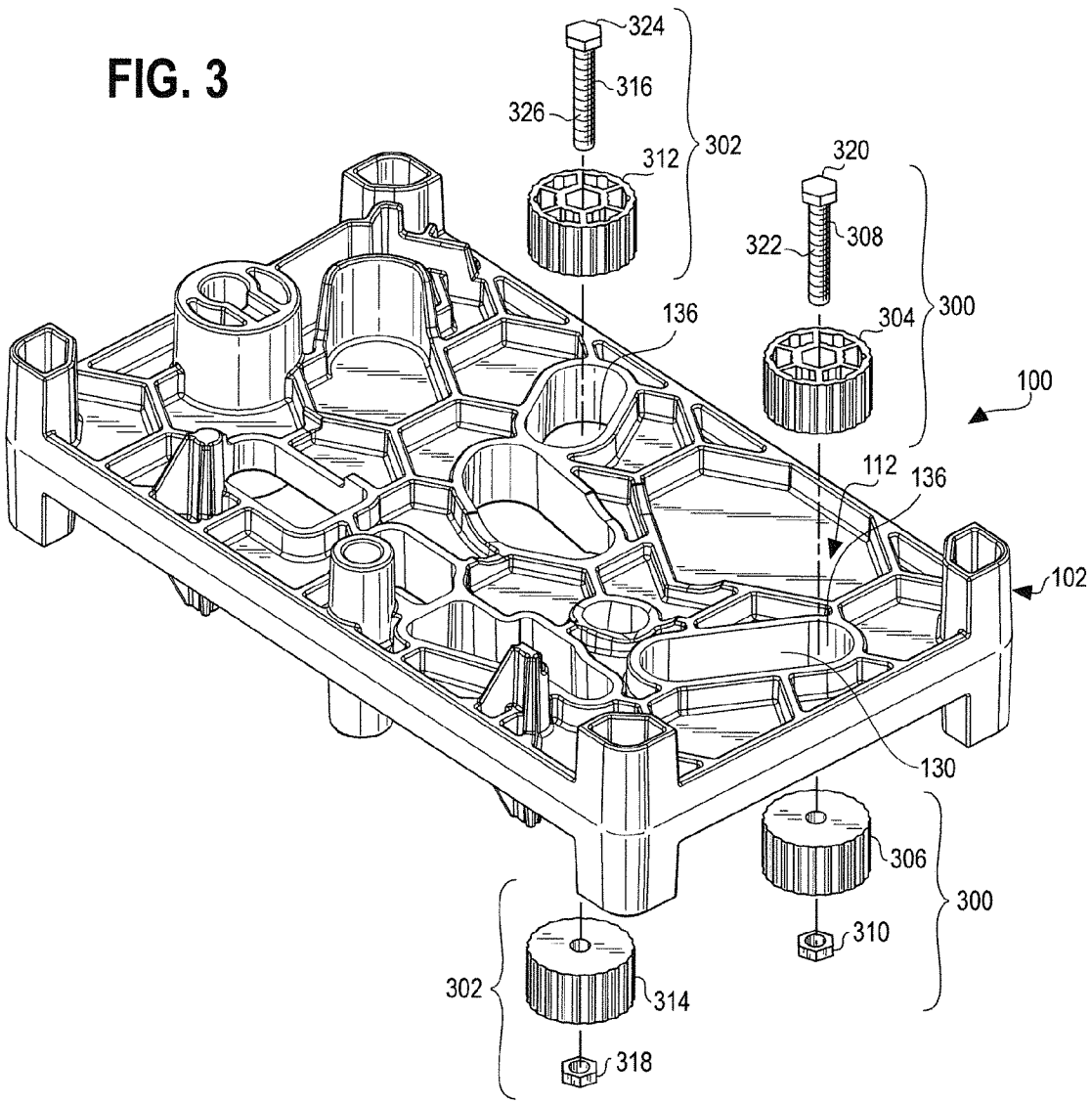
FIG. 3 is an exploded view of the firearm with the top face of the support plate facing upwards.

Referring next to FIG. 3, a perspective view of the firearm support apparatus 100 including exploded views of the first moveable boss 300 and the second moveable boss 302 is shown. Shown are the support plate 102, the top face 112, the first boss cutout 130, the second boss cutout 136, the first moveable boss 300, the second moveable boss 302, a first top cylinder 304, a first bottom cylinder 306, a first bolt 308, a first nut 310, a second top cylinder 312, a second bottom cylinder 314, a second bolt 316, a second nut 318, a first bolt head 320, a first bolt shaft 322, a second bolt head 324, and a second bolt shaft 326.

The first moveable boss 300 includes the first top cylinder 304, the first bottom cylinder 306, the first bolt 308 and the first nut 310. In the present embodiment, the first top cylinder 304 and the first bottom cylinder 306 are identical, and are described below in FIGS. 5-7.

The first top cylinder 304 and the first bottom cylinder 306 each include the bolt hole 512, as described further below in FIGS. 5-8.

The first bolt 308 includes the first bolt head 320 and the first bolt shaft 322. In the present embodiment, the first bolt head 320 is hexagonal and configured to snugly fit within the perimeter of a hexagonal cavity 504 of the first top cylinder 304, as shown below in FIG. 8. The first bolt shaft 322 is threaded and is configured to pass through the bolt hole 512. The first nut 310 is sized to threadably couple with an end of the first bolt shaft 322. As shown, the first bolt 308 passes through the first top cylinder 304 such that the first bolt shaft 322 passes through the bolt hole 512 of the first top cylinder 304 and the first bolt head 320 is coupled to a cylinder base 510. The first bolt shaft 322 then passes through the first boss cutout 130 and through the bolt hole 512 of the first bottom cylinder 306. The first nut 310 is then threadably coupled to the end of the first bolt shaft 322, sandwiching the support plate 102 between the first top cylinder 304 and the first bottom cylinder 306.

In a similar manner, the support plate 102 is sandwiched between the second top cylinder 312 and the second bottom cylinder 314 at the second boss cutout 136, using the threaded second bolt 316 and the second nut 318.

Referring again to FIG. 3, the exploded view illustrates the formation of the first moveable boss 300 by the coupling of the first top cylinder 304 to the first bottom cylinder 306 using the first bolt 308 and first nut 310, and the formation of the second moveable boss 302 by the coupling of the second top cylinder 312 to the second bottom cylinder 314 using the second bolt 316 and the second nut 318. The use of a bolt-and-nut system allows for adjustability of tightness of the moveable boss 300, 302 against the support plate 102, allowing the moveable boss 300, 302 to be loosened for slidability or tightened to secure the moveable boss 300, 302 to the support plate 102 in a fixed location for securing the firearm 1300 to the firearm support apparatus 100.

The usage of the top cylinder 304, 312 and the bottom cylinder 306, 314 allows for both a means for adjusting the tightness of the moveable boss 300, 302 and for the firearm support apparatus 100 to be used with either the top face 112 upwards with the top cylinders 304, 312 juxtaposed with the firearm 1300, or the bottom face 200 upwards with the bottom cylinders 306, 314 juxtaposed with the firearm 1300.

Figure 4:
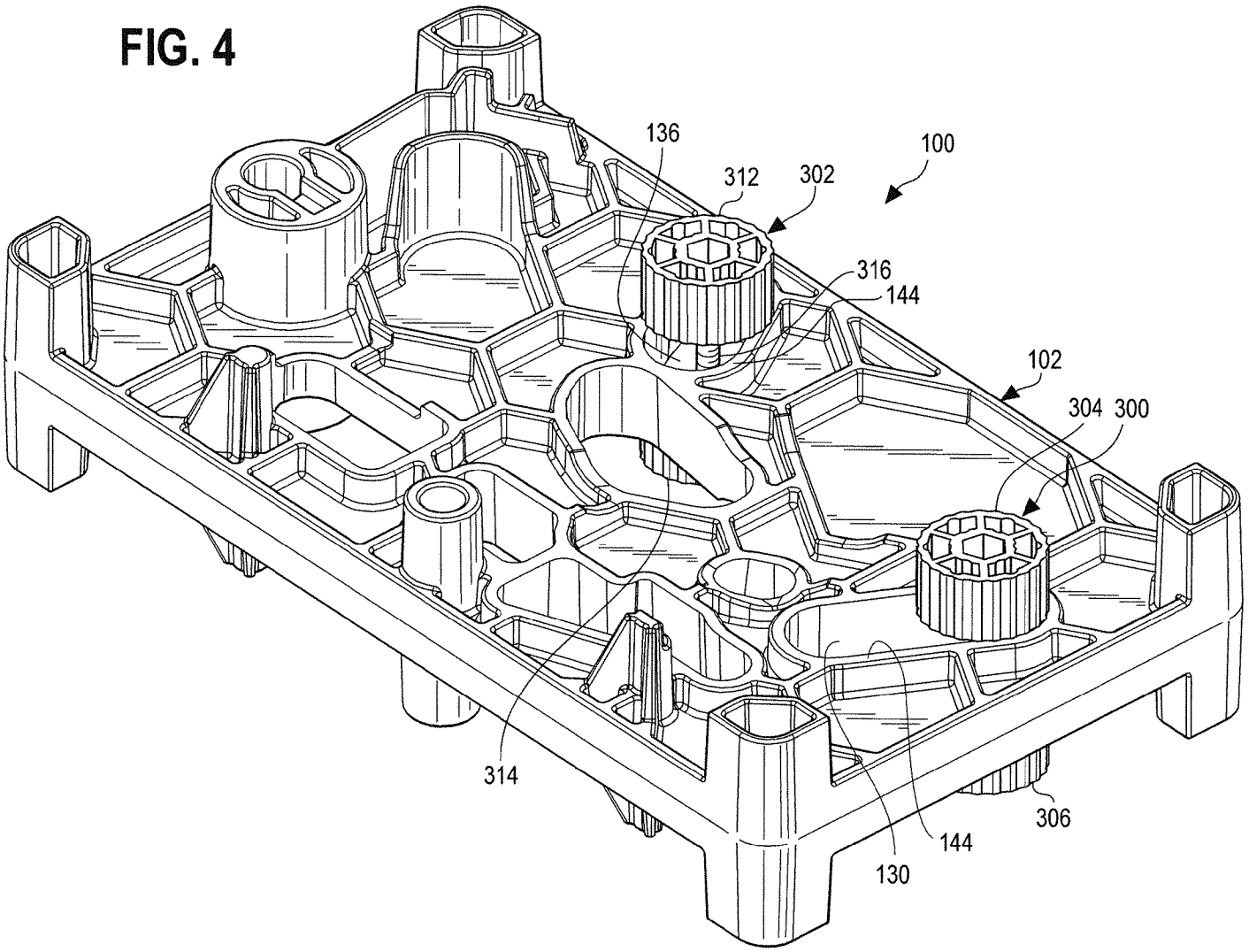
FIG. 4 is a perspective view of the firearm support apparatus with the top face of the support plate facing upwards.

Referring next to FIG. 4, a perspective view of the firearm support apparatus 100 is shown in one embodiment of the present invention. Shown are the support plate 102, the first boss cutout 130, the second boss cutout 136, the plurality of cutout perimeter walls 144, the first moveable boss 300, the second moveable boss 302, the first top cylinder 304, the first bottom cylinder 306, the second top cylinder 312, the second bottom cylinder 314, and the second bolt 316.

The first moveable boss 300 and the second moveable boss 302 are shown coupled to the support plate 102. The support plate 102 is shown with the top face 112 facing upwards when the firearm support apparatus 100 is supported by the external support.

As previously described in FIG. 3, the first moveable boss 300 is coupled to the support plate 102 such that the first moveable boss 300 slides across a portion of the support plate 102 when the coupling is loosened, but is frictionally coupled to the support plate 102 when the first bolt 308 is tightened. The first moveable boss 300 has a range of slidable movement limited by the contact of the first bolt shaft 322 with an edge of the first boss cutout 130. The sliding of the first moveable boss 300 allows for the first moveable boss 300 to be slid away from the firearm 1300 when the firearm 1300 is supported by the support plate 102, providing clearance for the firearm 1300 to be placed on the support plate 102. Advantageously, while the first moveable boss 300 is adjustable, the first moveable boss 300 remains coupled to the support plate 102 as a result of the first bolt 308 passing through the first boss cutout 130, preventing misplacement of the first moveable boss 300.

After the firearm 1300 is placed on the top face 112, the first moveable boss 300 is then slid to juxtapose the curved side of the first top cylinder 304 of the first moveable boss 300 with a concave portion of the firearm 1300 where a rear portion of a grip meets a back strap 1308. The first bolt 308 is then tightened, frictionally coupling the first moveable boss 300 to the support plate 102. The extent of the first boss cutout 130 allows for sliding adjustments to be made to secure different types and configurations of firearms. The coupling of the first moveable boss 300 to the firearm support apparatus 100 is described further below in FIG. 8.

Similarly to the first moveable boss 300, the second moveable boss 302 is coupled to the support plate 102 at the second boss cutout 136 such that the second moveable boss 302 slides across a portion of the support plate 102 when the coupling is loosened, but is frictionally coupled to the support plate 102 when the second bolt 316 is tightened. The second moveable boss 302 has a range of slidable movement limited by the contact of the second bolt shaft 326 with the edge of the second boss cutout 136. The sliding of the second moveable boss 302 allows for the second moveable boss 302 to be slid away from the firearm 1300 along the plane of the support plate 102 when the firearm 1300 is supported by the support plate 102, providing clearance for the firearm 1300 to be placed on the support plate 102. As with the first moveable boss 300, while the second moveable boss 302 is adjustable, the second moveable boss 302 remains coupled to the support plate 102 as a result of the second bolt 316 passing through the second boss cutout 136, preventing misplacement of the second moveable boss 302.

Figure 5:
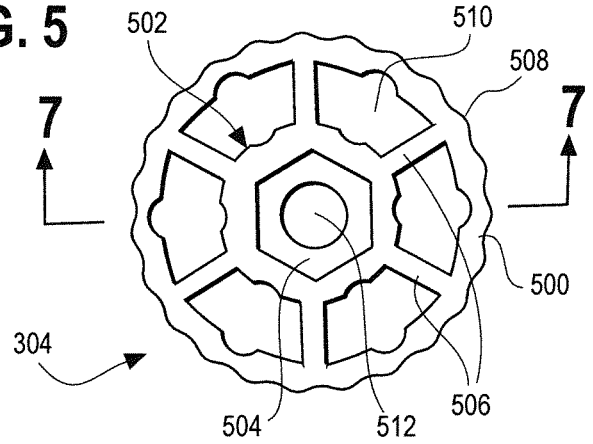
FIG. 5 is a top plan view of a first top cylinder of the firearm support apparatus.

Referring next to FIG. 5, a plan view of the first top cylinder 304 is shown. In the present embodiment, the first bottom cylinder 306, the second top cylinder 312 and the second bottom cylinder 314 are identical to the first top cylinder 304. Shown are a cylinder perimeter wall 500, a hexagonal wall 502, the hexagonal cavity 504, a plurality of vertical ribs 506, a plurality of outer ridges 508, the cylinder base 510, and a bolt hole 512.

In plan view, the cylinder perimeter wall 500 is approximately pipe-shaped. An outer diameter of the perimeter wall 500 is configured to be supported by at least two opposite edges of the corresponding boss cutout 130, 136. A height of the cylinder perimeter wall 500 is approximately ½".

The interior hexagonal wall 502 is concentric with the cylinder perimeter wall 500, and matches the height of the perimeter wall 500. The interior hexagonal wall 502 surrounding the hexagonal cavity 504 of the first top cylinder 304 is configured to snugly fit both the hexagonal first bolt head 320 and the first bolt 308. The plurality of interior vertical ribs 506 connects the cylinder perimeter wall 500 to the hexagonal wall 502, and matches the height of the perimeter wall 500. In the embodiment shown, the first top cylinder 304 includes six interior vertical ribs 506. Each vertical rib 506 is coupled to the hexagonal wall 502 at one end and to the perimeter wall 500 at the other end. The vertical ribs 506 are coupled to the hexagonal wall 502 at the hexagonal wall 502 vertex locations.

The cylinder perimeter wall 500 includes the plurality of outer ridges 508. The outer ridges 508 are vertical indentations in an outer surface of the first top cylinder 304 that result in a corrugation of the outer surface of the first top cylinder 304. In the embodiment shown, the outer ridges 508 extend from a top face 112 of the first top cylinder 304 to approximately 1/16" from the bottom face 200 of the first top cylinder 304.

The cylinder base 510 of the first top cylinder 304 is disc-shaped and extends to the cylindrical outer surface of the first top cylinder 304. The cylinder base 510 is integrally coupled to the perimeter wall 500, the hexagonal wall 502, and the plurality of interior vertical ribs 506.

The bolt hole 512 is a circular hole in the base 510 and is configured to allow the first bolt shaft 322 to pass through the bolt hole 512 while providing enough surface of the base 510 to couple the bolt head to the base 510. The bolt hole 512 is concentric with the cylinder perimeter wall 500.

Referring again to FIG. 5, a detailed plan view of the first top cylinder 304 is shown. For simplification of manufacturing and of usage, the moveable bosses 300, 302 are configured to use identical, interchangeable cylinders. It should be noted that other embodiments may include differing top and bottom cylinders and differing first boss cylinders and second boss cylinders. A diameter of the cylinder perimeter wall 500 is large enough to be supported by both edges of the first boss cutout 130 regardless of the position of the first bolt shaft 322 relative to the edge of the first boss cutout 130. The diameter of the cylinder perimeter wall 500 is also configured to provide a seat for the first bolt head 320.

The hexagonal wall 502 is shaped so that the interior face of the hexagonal wall 502 snugly fits both the first bolt head 320 and an outer perimeter of the first nut 310. The snug fitting restrains the first bolt head 320 and the first nut 310 from rotating with respect to the first top cylinder 304 or the first bottom cylinder 306 when either first cylinder 304, 306 is rotated, allowing the first moveable boss 300 to be easily loosened or tightened without removing the moveable boss 300 from the support plate 102.

The interior vertical ribs 506 provide additional rigidity to the first top cylinder 304 while decreasing the amount of material used in the first top cylinder 304. Those skilled in the art will note that the number and size of ribs 506 may be altered, or the first top cylinder 304 may be solid except for the hexagonal cavity 504.

The outer ridges 508 provide a gripping surface to assist a user while rotating the first top cylinder 304, and also provide a gripping surface for the frictional coupling of the first top cylinder 304 to the firearm 1300.

The bolt hole 512 provides access for the first bolt shaft 322 to pass through the first top cylinder 304 with the first bolt head 320 coupled to the portion of the base 510 surrounding the cylinder.

It should be noted that while the first moveable boss 300 is described in FIG. 5, the description applies equally to the second moveable boss 302.

Figure 6:
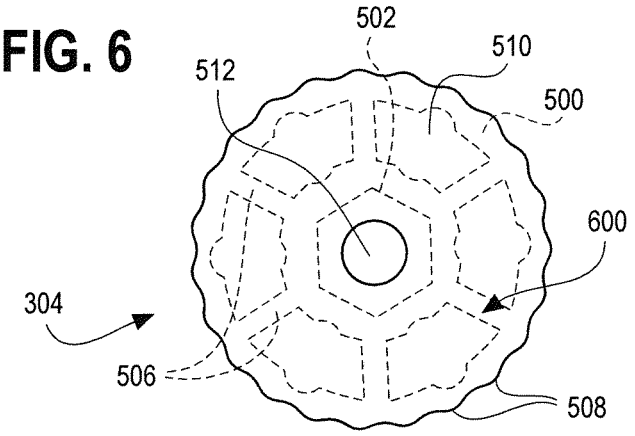
FIG. 6 is a bottom plan view of the first top cylinder of the firearm support apparatus.

Referring next to FIG. 6, a plan view of the bottom face 200 of the first top cylinder 304 is shown. Shown are the cylinder perimeter wall 500, the hexagonal wall 502, the plurality of vertical ribs 506, the plurality of outer ridges 508, the cylinder base 510, the bolt hole 512, and a base bottom face 600.

The base bottom face 600 is visible in FIG. 6. The cylinder perimeter wall 500, the hexagonal wall 502 and the interior vertical ribs 506 are not visible, but are indicated by the hidden lines in FIG. 6. The bolt hole 512 as described above in FIG. 5 is also shown. The outer ridges 508 are shown as previously described in FIG. 5.

The base bottom face 600 is smooth, to allow for sliding across the cutout perimeter walls 144 of the boss cutouts 130, 136 for moveable boss 300, 302 adjustment, as described further below in FIGS. 8, 9.

Figure 7:
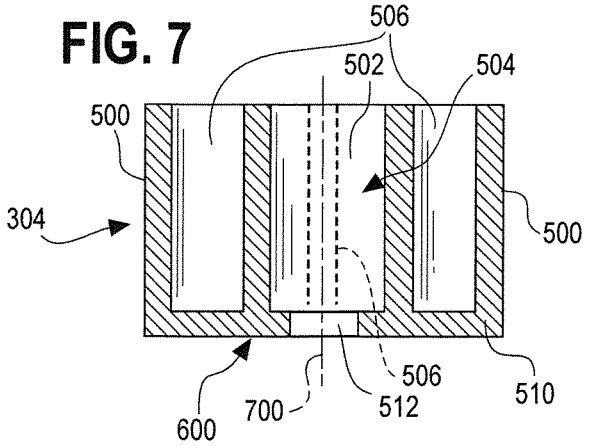
FIG. 7 is a cross-sectional view of the first top cylinder of the firearm support apparatus.

Referring next to FIG. 7, a cross-sectional diagram of the first top cylinder 304 in one embodiment of the invention is shown. Shown are the cylinder perimeter wall 500, the hexagonal wall 502, the hexagonal cavity 504, the plurality of vertical ribs 506, the cylinder base 510, the bolt hole 512, and the cylinder centerline 700.

As noted previously, the first bottom cylinder 306, the second top cylinder 312, and the second bottom cylinder 314 are geometrically identical to the first top cylinder 304. As previously described in FIGS. 5 and 6, the perimeter wall 500 and hexagonal wall 502 extend the entire height of the first top cylinder 304 and are integrally coupled to the base bottom face 600. In the section shown in FIG. 7, the cylinder perimeter wall 500 is shown in cross-section, and the hexagonal wall 502 is shown partly in cross-section and partly in elevation.

Two interior vertical ribs 506 are seen in elevation in the section, and one vertical rib 506 is shown as being located beyond the hexagonal wall 502. The vertical ribs 506 are as previously described in FIGS. 5 and 6.

The bolt hole 512 is shown located in the cylinder base 510, as previously described in FIGS. 5 and 6. The cylinder centerline 700 is shown at the vertical center of symmetry of the cross-section.

Referring again to FIG. 7, as previously stated the hexagonal cavity 504 is shaped to provide the snug seat for the first bolt head 320 and the first nut 310, as shown below in FIG. 8. A plurality of perimeter cavities formed by the vertical ribs 506 reduce the amount of material used in manufacturing of the first top cylinder 304, while still providing the necessary stiffness and rigidity of the first top cylinder 304 to frictionally couple the cylinder to the firearm 1300.

Figure 8:
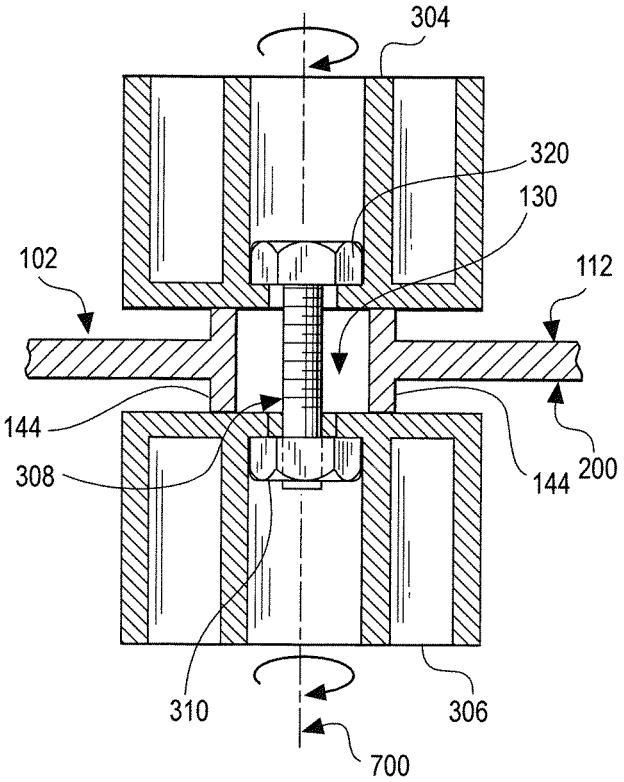
FIG. 8 is a cross-sectional view of a first moveable boss coupled to the support plate.

Referring next to FIG. 8, a cross-sectional diagram showing the first moveable boss 300 as installed on the support plate 102 is shown. Shown are the support plate 102, the top face 112, the cutout perimeter wall 144, the bottom face 200, the first top cylinder 304, the first bottom cylinder 306, the first bolt 308, the first nut 310, the first bolt head 320, and the cylinder centerline 700.

As previously described, the first top cylinder 304 is coupled to the first bottom cylinder 306 using the first bolt 308 and the first nut 310. The bottom face 200 of the base 510 of the first top cylinder 304 is juxtaposed with the perimeter wall of the first boss cutout 130 extending outward from the top face 112 of the support plate 102. The first bolt 308 is passed through the bolt hole 512 in the first top cylinder 304 so that the first bolt head 320 is rotationally restrained by the hexagonal wall 502 of the first top cylinder 304, and the first bolt shaft 322 passes through the bolt hole 512 of the first top cylinder 304 and through the first boss cutout 130.

The base bottom face 600 of the first bottom cylinder 306 is juxtaposed with the first boss cutout 130 perimeter wall extending outward from the bottom face 200 of the support plate 102. The first bolt shaft 322 passes through the bolt hole 512 of the first bottom cylinder 306 and extends into hexagonal cavity 504 of the first bottom cylinder 306. To couple the first moveable boss 300 to the support plate 102, the first nut 310 is placed in the hexagonal cavity 504 of the first bottom cylinder 306 such that a hole of the first nut 310 is juxtaposed with the end of the first bolt shaft 322. The first nut 310 is threaded on to the end of the first bolt shaft 322 by holding the first top cylinder 304 motionless and rotating the first bottom cylinder 306, thus threading the first nut 310 onto the first bolt shaft 322 and coupling the first moveable boss 300 to the support plate 102.

Continued rotating of the first bottom cylinder 306 draws the first bottom cylinder 306 closer to the first top cylinder 304 until juxtaposition of the bottom face 200 of each first cylinder 304, 306 with the cutout perimeter walls 144 prevents further rotation and frictionally couples the first moveable boss 300 to the support plate 102. Rotating of the first bottom cylinder 306 in the opposite direction separates the first cylinders 304, 306, allowing for sliding of the first moveable boss 300 relative to the support plate 102. Further rotating of the first bottom cylinder 306 detaches the first nut 310 from the first bolt 308. It should be noted that alternately the first top cylinder 304 may be rotated with respect to the first bottom cylinder 306, or both first cylinders 304, 306 may be rotated simultaneously in opposite directions, to obtain the same result.

The installation, tightening and loosening of the first moveable boss 300 to the support plate 102 applies equally to the second moveable boss 302, utilizing instead the second top cylinder 312, the second bottom cylinder 314, the second bolt 316, and the second nut 318 in lieu of the first top cylinder 304, the first bottom cylinder 306, the first bolt 308 and the first nut 310.

Referring again to FIG. 8, the cross-section illustrates how first moveable boss 300 is coupled to the support plate 102. The embodiment shown allows for the first moveable boss 300 to be disassembled and removed from the support plate 102, to be moved to various positions along the support plate 102, and to be frictionally restrained on the support plate 102.

When the first top cylinder 304 and the first bottom cylinder 306 are coupled using the first bolt 308 and the first nut 310, with the first bolt shaft 322 passing through the first boss cutout 130, the first moveable boss 300 may be adjusted to various positions relative to the support plate 102 by sliding the first moveable boss 300 in a direction parallel to the horizontal plane of the support plate 102. The extent of the adjustment is limited by the first bolt 308 being surrounded by the cutout perimeter walls 144 of the first boss cutout 130.

As a result, the first moveable boss 300 may be slidingly moved so that a portion of the outer surface of the first top cylinder 304, or a portion of the outer surface of the first bottom cylinder 306, is juxtaposed with a portion of a firearm 1300, and then tightened to secure the firearm 1300 to the support plate 102, as shown further below in FIG. 13.

The adjustment capacity of the first moveable boss 300 also accommodates different models and types of firearms 1300. To remove the firearm 1300 from the block, the first moveable boss 300 is loosened and slid away from the firearm 1300. In the current embodiment, the moveable bosses 300, 302 and the boss cutouts 130, 136 are configured to secure Smith and Wesson Semi-Automatic M&P pistols and Glock Semi-Automatic Pistols, but those skilled in the art will note that the invention may be modified to accommodate additional makes and models of firearms 1300.

Figure 9:
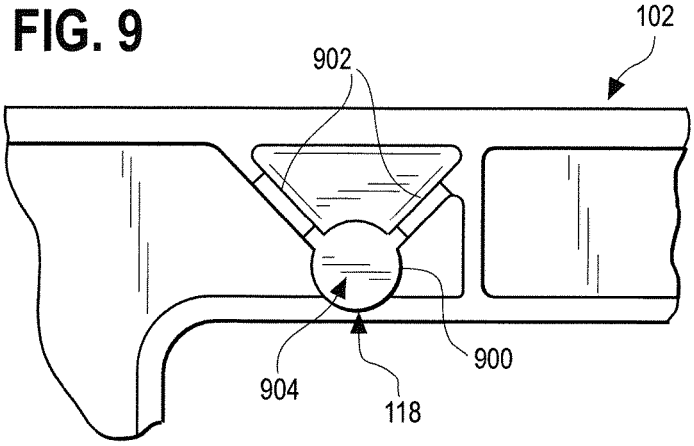
FIG. 9 is a plan view of a front top frame projection of the firearm support apparatus.

Referring next to FIG. 9, a plan view of the front top frame projection 118 of the firearm support apparatus 100 is shown. Shown are the support plate 102, the front top frame projection 118, a front top frame projection cylinder 900, two front top frame projection flukes 902, and a front top frame projection top face 904.

The front top frame projection 118 includes the vertical front top frame projection cylinder 900 and the two front top frame projection flukes 902. Each front top frame projection fluke 902 is coupled to both a side of the top frame projection cylinder and a front top frame projection top face 904. The two front top frame projection flukes 902 are oriented so that when the front top frame projection top face 904 is viewed, the two front top frame projection flukes 902 form an approximate obtuse isosceles triangle, with an apex at the front top frame projection top face 904 and a triangle base integrally coupled to the top face 112. The front top frame projection flukes 902 are oriented at an approximately 45 degree angle with respect to the barrel edge 104.

Referring again to FIG. 9, the front top frame projection 118 is configured to juxtapose with the top of the barrel 1302 when the firearm 1300 is coupled to the firearm support apparatus 100. The front top frame projection cylinder 900 diameter is configured to provide a narrow point of contact between the front top frame projection 118 and the firearm 1300. The front top frame projection flukes 902 provide rigidity to the front top frame projection cylinder 900 in a direction normal to the barrel edge 104.

Figure 10:
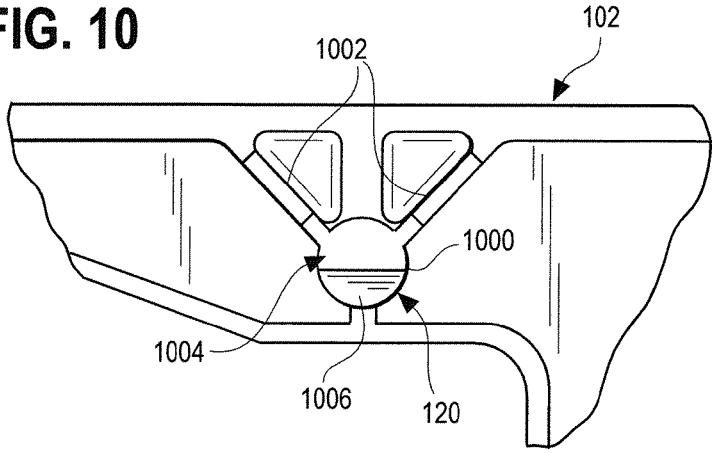
FIG. 10 is a plan view of a rear top frame projection of the firearm support apparatus.

Referring next to FIG. 10, a plan view of the rear top frame projection 120 of the firearm support apparatus is shown. Shown are the support plate 102, the rear top frame projection 120, the rear top frame projection cylinder 1000, the two rear top frame projection flukes 1002, the rear top frame projection top face 1004, and the rear top frame projection notch 1006.

The rear top frame projection 120 is similar in geometry to the front top frame projection 118, with the exception that the rear top frame projection cylinder 1000 includes the approximately semicircular rear top frame projection notch 1006 in the rear top frame projection top face 1004, distal to the barrel edge 104.

Referring again to FIG. 10, the rear top frame projection 120 is configured to juxtapose with the top of the barrel 1302 when the firearm 1300 is coupled to the firearm support apparatus 100. The rear top frame projection cylinder 1000 diameter is configured to provide a narrow point of contact between the rear top frame projection 120 and the firearm 1300. The rear top frame projection flukes 1002 provide rigidity to the rear top frame projection cylinder 1000 in the direction normal to the barrel edge 104.

The rear top frame projection notch 1006 is configured to provide clearance for a Glock pistol disconnector tab of a firearm 1300 when the firearm 1300 is coupled to the firearm support apparatus.

Figure 11:
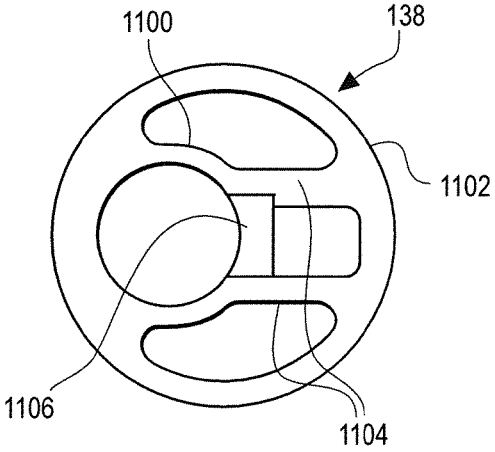
FIG. 11 is a plan view of a top striker holder of the firearm support apparatus.

Referring next to FIG. 11, a plan view of the top striker holder 138 of the firearm support apparatus 100 is shown. Shown are an interior pipe-shaped wall 1100, a striker perimeter wall 1102, a plurality of interior flange walls 1104, and a top striker holder notch 1106.

The interior pipe-shaped wall 1100 is integrally coupled to the support plate 102 and the striker perimeter wall 1102, and is located so that the interior pipe-shaped wall 1100 coincides with the striker perimeter wall 1102 at an striker perimeter wall 1102 edge proximate to the front edge 108 (i.e., there exists only one tangent line to both the striker perimeter wall 1102 and the interior pipe-shaped wall 1100). The interior pipe-shaped wall 1100 is the same height as the striker perimeter wall 1102.

Two parallel interior flange walls 1104 integrally couple the interior pipe-shaped wall 1100 to an edge of the striker perimeter wall 1102 proximate to the rear edge 110. The interior flange walls 1104 are generally the same height as the striker perimeter wall 1102. The interior flange walls 1104 are oriented approximately parallel to the magazine edge 106, and are configured to support a striker base 1502, as shown below in FIG. 15.

A portion of the interior pipe-shaped wall 1100 is recessed, forming the top striker holder notch 1106. The recessed portion begins at an interior face of the interior flange wall 1104 proximate to the magazine edge 106, and continues towards the barrel edge 104 until a location within the thickness of the interior flange proximate to the barrel edge 104. The top striker holder notch 1106 is recessed approximately ⅛" below a top surface of the interior pipe-shaped wall 1100.

Referring again to FIG. 11, the top striker holder 138 is configured to demountably couple the striker 1500 of the firearm 1300 to the firearm support apparatus 100, as described further below in FIG. 15.

The top striker holder notch 1106 extends past the face of the interior flange wall 1104 proximate to the barrel edge 104 such that the top striker holder 138 is configured to support the striker 1500 for Smith and Wesson M&P, SD and Sigma series semi-automatic pistols, Glock pistols, and other makes and models of pistols including similar stricker configurations.

Figure 12:
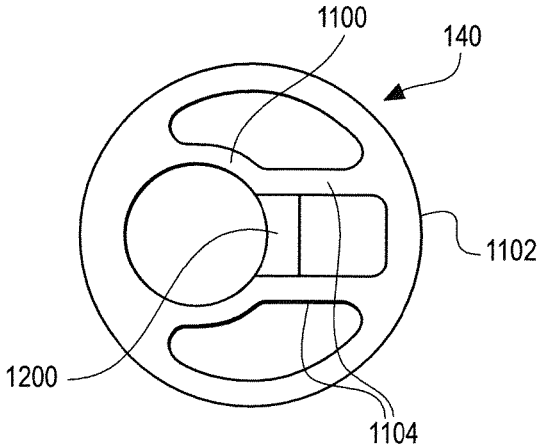
FIG. 12 is a plan view of a bottom striker holder of the firearm support apparatus.

Referring next to FIG. 12, a plan view of the bottom striker holder 140 of the firearm support apparatus 100 is shown. Shown are the interior pipe-shaped wall 1100, the striker perimeter wall 1102, the plurality of interior flange walls 1104, and a bottom striker holder notch 1200.

The bottom striker holder 140 is a mirror image of the top striker holder 138, with the exception of the bottom striker holder notch 1200.

The bottom striker holder notch 1200 is formed by a recessed portion of the interior pipe-shaped wall 1100 of the bottom striker holder 140 extending from the interior face of the interior flange wall 1104 proximate to the magazine edge 106 to the interior face of the interior flange wall 1104 proximate to the barrel edge 104.

Referring again to FIG. 12, the bottom striker holder 140 is configured to support a different striker configuration than the top striker holder 138. In the present embodiment, the bottom striker holder 140 is configured for the striker of a .357 Sig pistol, a .40 S&W pistol, or a 9 mm S&W pistol, but it will be readily apparent to those skilled in the art that the top striker holder 138 may be modified for other makes and models of firearms 1300. The use of the bottom striker holder 140 is described further below in FIG. 15.

Figure 13:
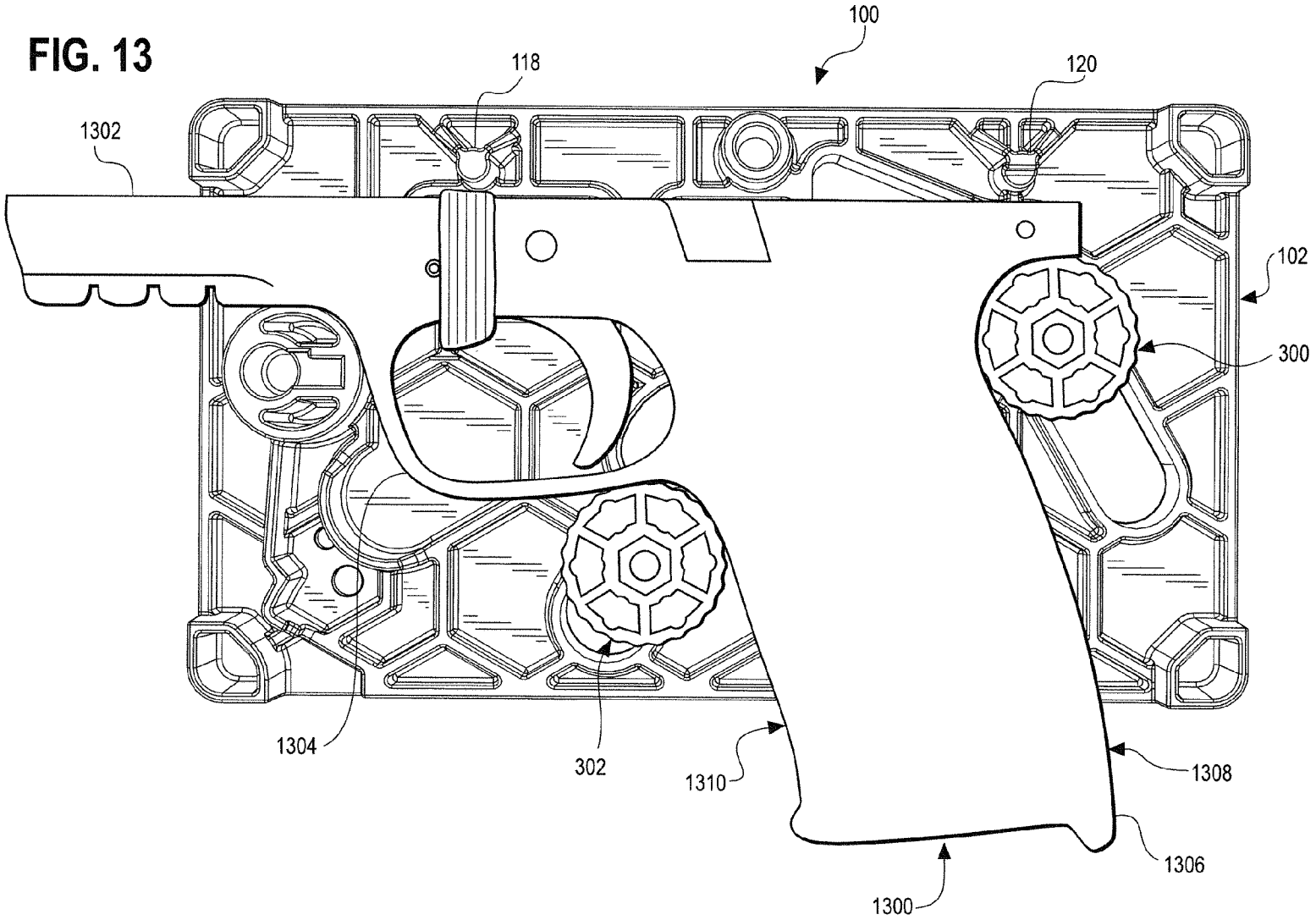
FIG. 13 is a plan view of a firearm secured to the top face of the firearm support apparatus, with the top face facing upwards.

Referring next to FIG. 13, a plan view of the firearm 1300 secured to the firearm support apparatus 100 is shown. Shown are the support plate 102, the front top frame projection 118, the rear top frame projection 120, the barrel 1302, the trigger guard 1304 the magazine 1306, a back strap 1308, and a front strap 1310.

The firearm 1300 is shown secured to the top face 112 of the firearm support apparatus 100. Previous to placing the firearm 1300 on the support plate 102, the first moveable boss 300 and the second moveable boss 302 are loosened and slid towards the magazine edge 106 so that the firearm 1300 may be placed on the support plate 102.

The firearm 1300 is then placed horizontally on the support plate 102 so that the portion of the curved exterior surface of the top striker holder 138 is juxtaposed with the concave intersection of the barrel 1302 and the trigger guard 1304, with the barrel 1302 crossing over the barrel edge 104.

A top face of the barrel 1302 is restrained against movement by juxtaposing the front and rear top frame projections 118, 120 with the top face of the barrel 1302. The first moveable boss 300 is slid towards the barrel edge 104 until the curved exterior surface of the first top cylinder 304 is juxtaposed with the concave curve at the rear of the firearm 1300 at the top of the back strap 1308. The first moveable boss 300 is then tightened, as previously described in FIG. 8. The firearm 1300 is then secured to the first moveable boss 300.

The second moveable boss 302 is slid towards the barrel edge 104 until a curved exterior surface of the second top cylinder 312 is juxtaposed with the concave curve of the firearm 1300 where the trigger guard 1304 meets the front strap 1310 of the firearm 1300. The second moveable boss 302 is then tightened, as previously described in FIG. 8. The firearm 1300 is then secured to the second moveable boss 302.

Referring again to FIG. 13, the combined restraint of the front and rear top frame projections 118, 120, the top striker holder 138, the first moveable boss 300, and the second moveable boss 302 results in restraint of the firearm 1300 with respect to the horizontal plane of the support plate 102. Tightening of the first moveable boss 300 and the second moveable boss 302 against the firearm 1300 also provides frictional restraint against movement of the firearm 1300 normal to the plane of the support plate 102, allowing the firearm support apparatus 100 to be flipped over so that the side of the firearm 1300 proximate to the top surface is accessible through the various cutouts 124, 126, 128, 130, 132, 134, 136.

Those skilled in the art will note that alternately the firearm 1300 may be coupled to the bottom face 200 of the support plate 102.

Figure 14:
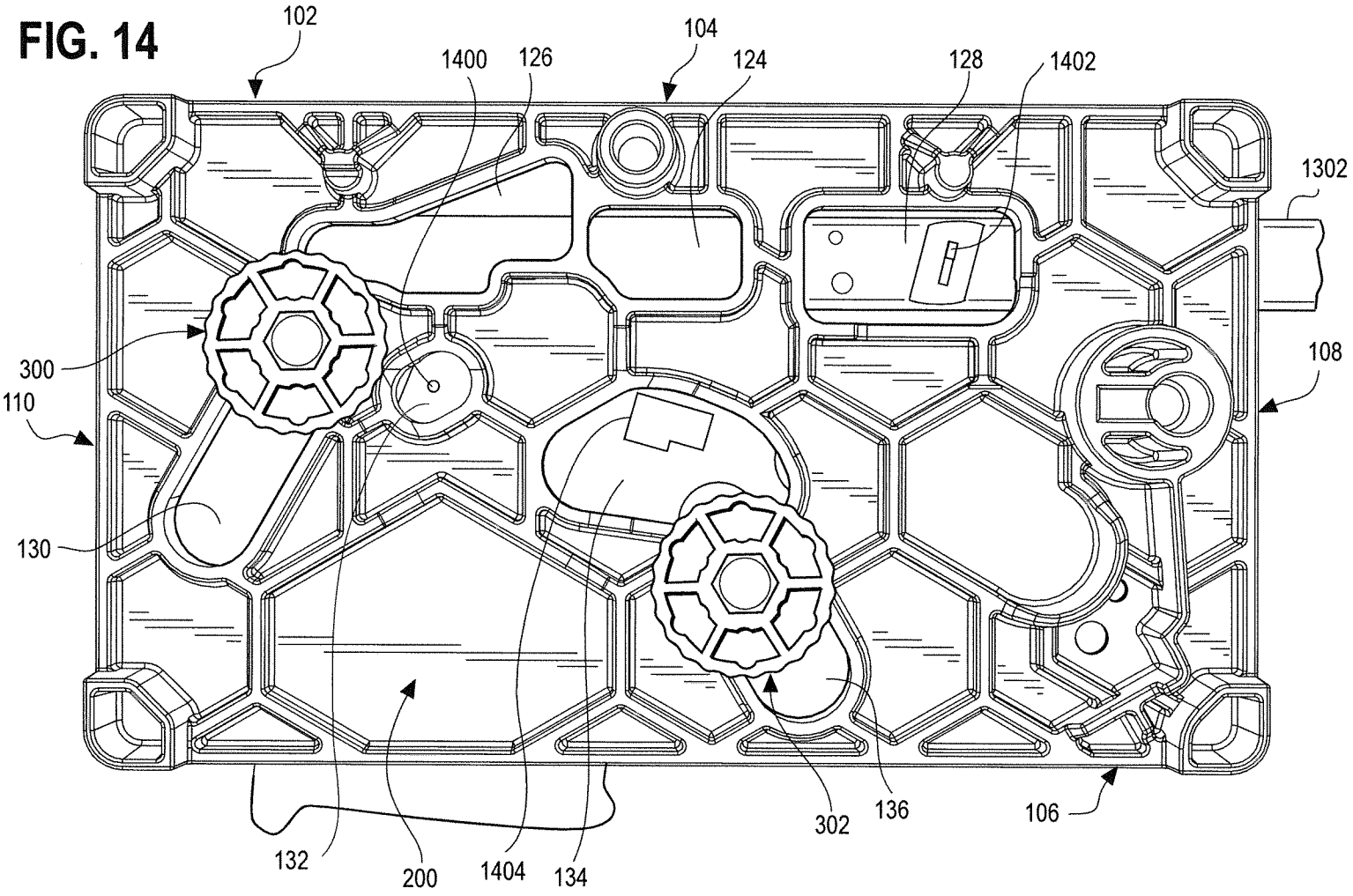
FIG. 14 is a plan view of the firearm secured to the top face of the firearm support apparatus, with the bottom face facing upwards.

Referring next to FIG. 14, a plan view of the bottom face 200 of the firearm support apparatus 100 is shown with the firearm 1300 coupled to the top face 112 (not shown) of the firearm support apparatus 100. Shown are the support plate 102, the barrel edge 104, the magazine edge 106, the front edge 108, the rear edge 110, the slide lock lever cutout 124, the thumb safety cutout 126, the frame takedown lever cutout 128, the first boss cutout 130, the sear housing pin cutout 132, the magazine release cutout 134, the second boss cutout 136, the bottom face 200, the first moveable boss 300, the second moveable boss 302, the barrel 1302, the sear housing pin 1400, a frame takedown lever 1402, and the magazine release 1404.

The firearm 1300 is coupled to the top face 112 of the firearm support apparatus 100 as previously described in FIG. 13. As illustrated in FIG. 10, the support plate 102 cutouts as previously described in FIG. 1 are configured to align with portions of the firearm 1300 when the firearm 1300 is coupled to the firearm support apparatus 100.

The frame takedown lever cutout 128 provides clearance for the frame takedown lever 1402 such that the firearm 1300 is horizontally supported by the support plate 102. The reduction of height of a portion of the frame takedown lever cutout 128 perimeter wall proximate to the frame takedown lever 1402 accommodates the frame takedown lever 1402 in the "down" orientation, where the down orientation extends from the barrel 1302 in the direction of the magazine edge 106 and the takedown lever is proximate to the supporting surface of the firearm support apparatus 100. In addition, the frame takedown lever cutout 128 allows for removal of a trigger pivot pin and a locking block coil pin when the firearm 1300 is coupled to the support plate 102.

The slide lock lever cutout 124 provides clearance around the slide lock lever such that the firearm 1300 is horizontally supported by the support plate 102.

The thumb safety cutout 126 provides clearance for the thumb safety 1900, in both the fire position 1904 and the safe position 1902, such that the firearm 1300 is horizontally supported by the support plate 102. The thumb safety cutout 126 is described further in FIG. 19.

The sear housing pin cutout 132 provides clearance for the sear housing pin 1400 of the firearm 1300, allowing the sear housing pin 1400 to be removed from the firearm 1300 and fall through the sear housing pin cutout 132.

The magazine release cutout 134 provides clearance for the magazine release 1404 such that the firearm 1300 is horizontally supported by the support plate 102.

Figure 15:
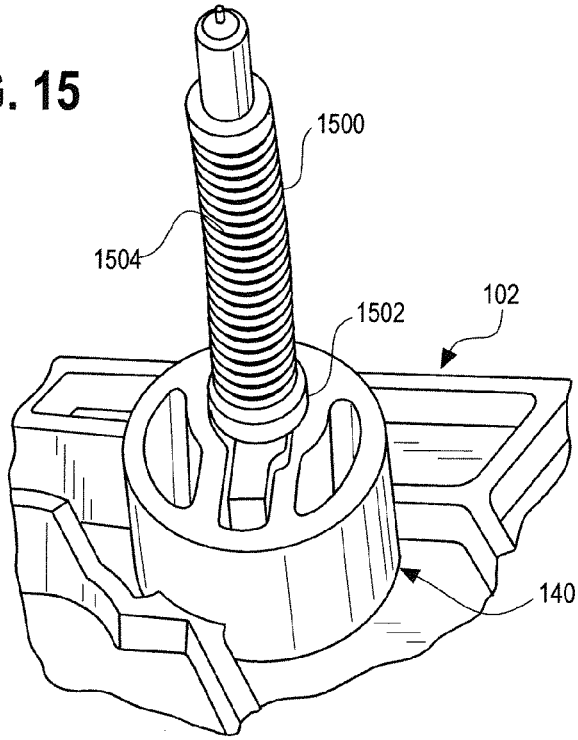
FIG. 15 is a perspective view of a striker of a firearm coupled to a bottom striker holder of the firearm support apparatus.

Referring next to FIG. 15, a perspective view of the striker 1500 of the firearm 1300 coupled to the top striker holder 138 of the firearm support apparatus 100 is shown. Shown are the support plate 102, the top striker holder 138, the striker 1500, a striker base 1502, and a spring 1504.

The striker 1500 is shown coupled to the top striker holder 138. The striker base 1502 snugly fits within the interior pipe-shaped wall 1100, demountably coupling the striker 1500 to the top striker holder 138 in a generally vertical orientation. The striker spring 1504 is coiled around a top portion of the striker 1500, such that when the striker 1500 is coupled to the top striker holder 138, the spring 1504 will automatically be supported by the striker base 1502. Additionally, the spring 1504 may be easily removed from the striker 1500 by lifting it in a vertical direction, and replaced in the same manner. As previously mentioned in FIGS. 1-2, 11-12, the configuration of the top striker holder 138 and the bottom striker holder 140 are different in the present embodiment of the invention in order to support multiple striker 1500 configurations.

Figure 16:
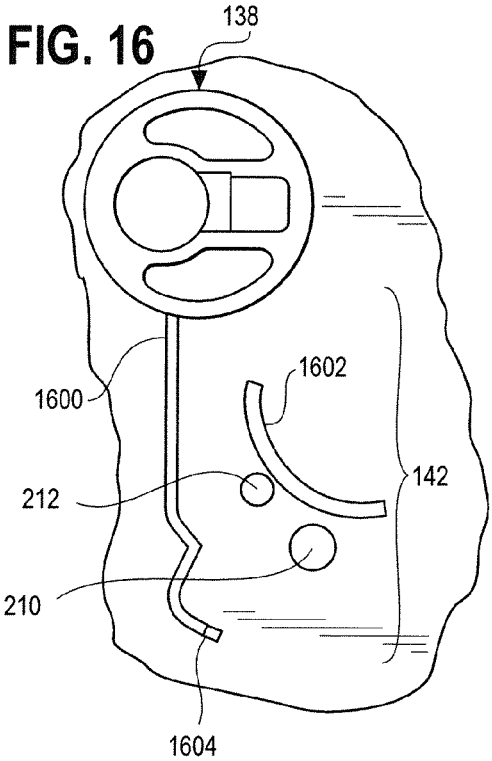
FIG. 16 is a plan view of a top trigger holder of the firearm support apparatus.

Referring next to FIG. 16, a plan view of the top trigger holder 142 of the firearm support apparatus 100 is shown. Shown are the top striker holder 138, the top trigger holder 142, the first trigger hole 210, the second trigger hole 212, a front top trigger wall 1600, a rear top trigger wall 1602, and a front top trigger wall extension 1604.

As previously described in FIG. 1, the top trigger holder 142 includes the front top trigger wall 1600 proximate to the front edge 108 and the rear top trigger wall 1602 proximate to the rear edge 110. The front top trigger wall 1600 is coupled to a side of the top striker holder 138 proximate to the magazine edge 106, and extends towards the magazine edge 106. The front top trigger wall 1600 is configured to align with a rear contour of the trigger 1800 (the rear contour referring to a contour of the trigger 1800 proximate to the magazine 1306 when the trigger 1800 is installed on the firearm 1300).

The rear top trigger wall 1602 is shaped in a shallow C-shape and is located proximate to the front top trigger wall 1600 in the direction of the rear edge 110. The rear top trigger wall 1602 is configured to provide, in conjunction with the front top trigger wall 1600, demountable coupling of the trigger 1800 between the front top trigger wall 1600 and the rear top trigger wall 1602 when the trigger 1800 is placed horizontally on the support plate 102. The trigger walls 1600, 1602 are oriented so that the trigger bar 1806 extends in the direction of the magazine edge 106, as shown below in FIG. 14.

The front top trigger wall 1600 includes the front top trigger wall extension 1604, extending from an edge of the front top trigger wall 1600 proximate to the magazine edge 106. The front top trigger wall extension 1604 is configured for.

The heights of the front top trigger wall 1600 and the rear top trigger wall 1602 are configured to allow for the use of a pin punch to remove pins from the trigger 1800 when the pin punch is larger in diameter than the width of the trigger 1800 at the pin location.

The first trigger hole 210 and the second trigger hole 212 are located in the support plate 102 between the front top trigger wall 1600 and the rear top trigger wall 1602. The first trigger hole 210 is configured to allow for the first trigger pin 1802 to pass through the support plate 102 when the trigger 1800 is coupled to the top trigger holder 142. The second trigger hole 212 is configured to allow for the second trigger pin 1804 to pass through the support plate 102 when the trigger 1800 is coupled to the top trigger holder 142.

Referring again to FIG. 16, the top trigger holder 142 provides a location for demountably coupling the trigger 1800 and the trigger bar 1806 to the support plate 102. Coupling the trigger 1800 to the support plate 102 advantageously holds the trigger 1800 in an accessible location while the firearm 1300 is undergoing maintenance. In addition, the trigger holder 142, 208 secures the trigger 1800 during removal of the first trigger pin 1802 and the second trigger pin 1804. The first trigger hole 210 and the second trigger hole 212 allow the trigger pins 1802, 1804 to pass through the support plate 102 below. The front top trigger wall 1600 is configured for various makes and models of pistol triggers 1800, including triggers 1800 compatible with Smith and Wesson SD and Sigma pistols.

Figure 17:
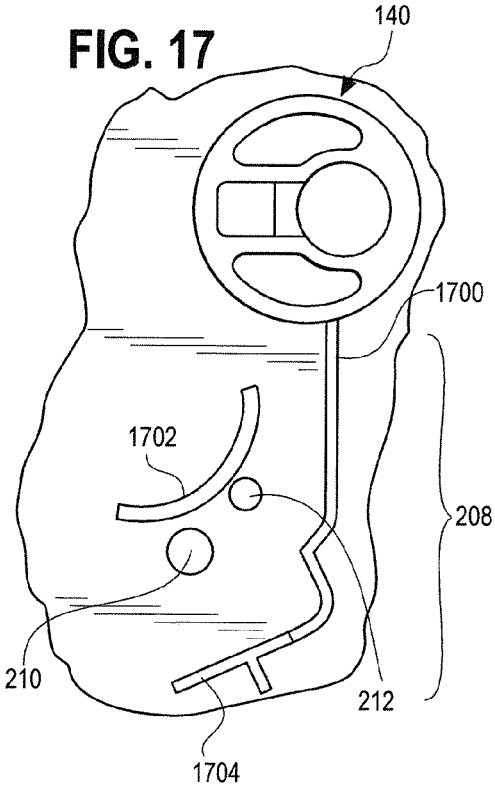
FIG. 17 is a plan view of a bottom trigger holder of the firearm support apparatus.

Referring next to FIG. 17, a detail of the bottom trigger holder 208 of the firearm support apparatus 100 is shown. Shown are the bottom striker holder 140, the bottom trigger holder 208, the first trigger hole 210, the second trigger hole 212, a front bottom trigger wall 1700, a rear bottom trigger wall 1702, and a front bottom trigger wall extension 1704.

The bottom trigger holder 208 is a mirror image of the top trigger holder 142, with the exception of the front bottom trigger wall extension 1704. The front bottom trigger wall extension 1704 extends from an edge of the front bottom trigger wall 1700 proximate to the magazine edge 106. The front bottom trigger wall extension 1704 is configured for additional support of the trigger bar 1806 when the trigger 1800 is supported by the bottom trigger holder 208.

Referring again to FIG. 17, the bottom trigger holder 208 provides a location for demountably coupling the trigger 1800 and the trigger bar 1806 to the support plate 102. Coupling the trigger 1800 to the support plate 102 advantageously holds the trigger 1800 in an accessible location while the firearm 1300 is undergoing maintenance. In addition, the trigger holder secures the trigger 1800 during removal of the first trigger pin 1802 and the second trigger pin 1804. The first trigger hole 210 and the second trigger hole 212 allow the trigger pins 1802, 1804 to pass through the support plate 102 below. The front bottom trigger wall 1700 is configured for various makes and models of pistol triggers 1800, including triggers 1800 compatible with Smith and Wesson SD and Sigma pistols.

Figure 18:
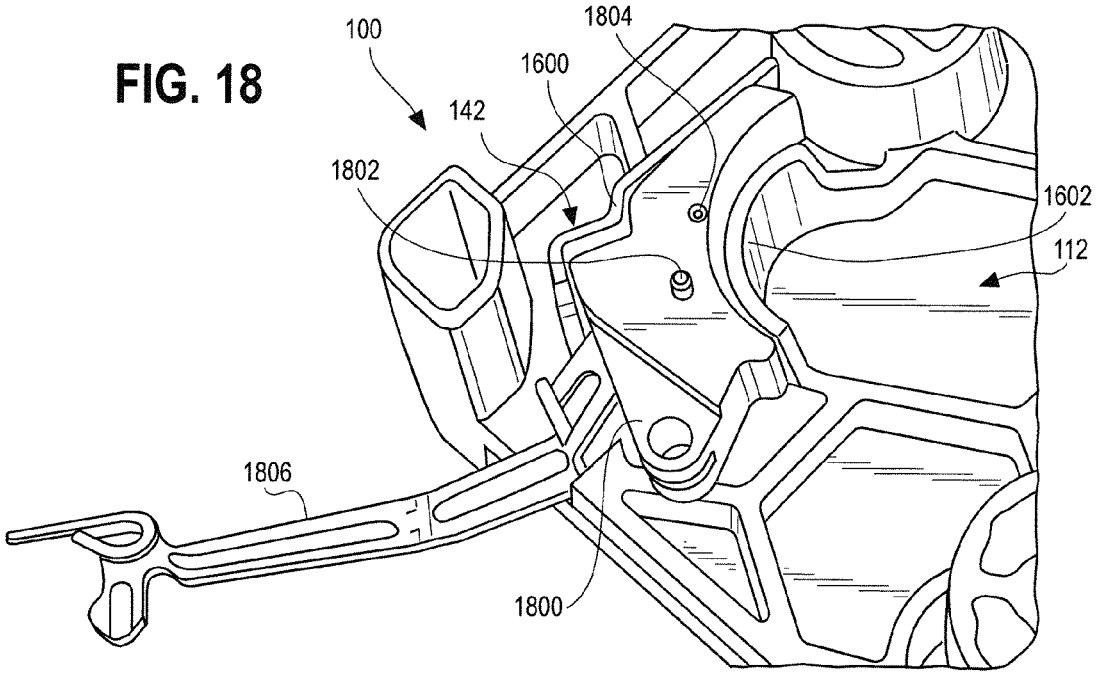
FIG. 18 is a perspective view of a trigger and a trigger bar coupled to the top trigger holder of the firearm support apparatus.

Referring next to FIG. 18, a perspective view of the trigger 1800 and the trigger bar 1806 are shown coupled to the top trigger holder 142 of the firearm support apparatus 100. Shown are the top face 112, the top trigger holder 142, the front top trigger wall 1600, the rear top trigger wall 1602, the trigger 1800, the first trigger pin 1802, the second trigger pin 1804, and the trigger bar 1806.

As previously described in FIGS. 16 and 17, the top trigger holder 142 is configured for demountable coupling of the trigger 1800, with or without the trigger bar 1806, to the support plate 102. As shown in FIG. 14, when the trigger 1800 is placed in a horizontal position between the front top trigger wall 1600 and the rear top trigger wall 1602, the trigger 1800 is demountably coupled to the support plate 102. The trigger walls 1600, 1602 are oriented so that the trigger bar 1806 may extend over a portion of the support plate 102 proximate to the magazine edge 106, and pass over the magazine edge 106.

The trigger holes 210, 212 (not shown) are configured to allow for removal of the first trigger pin 1802 and the second trigger pin 1804 when they are pressed through the trigger 1800 and through the trigger holes 210, 212.

Figure 19:
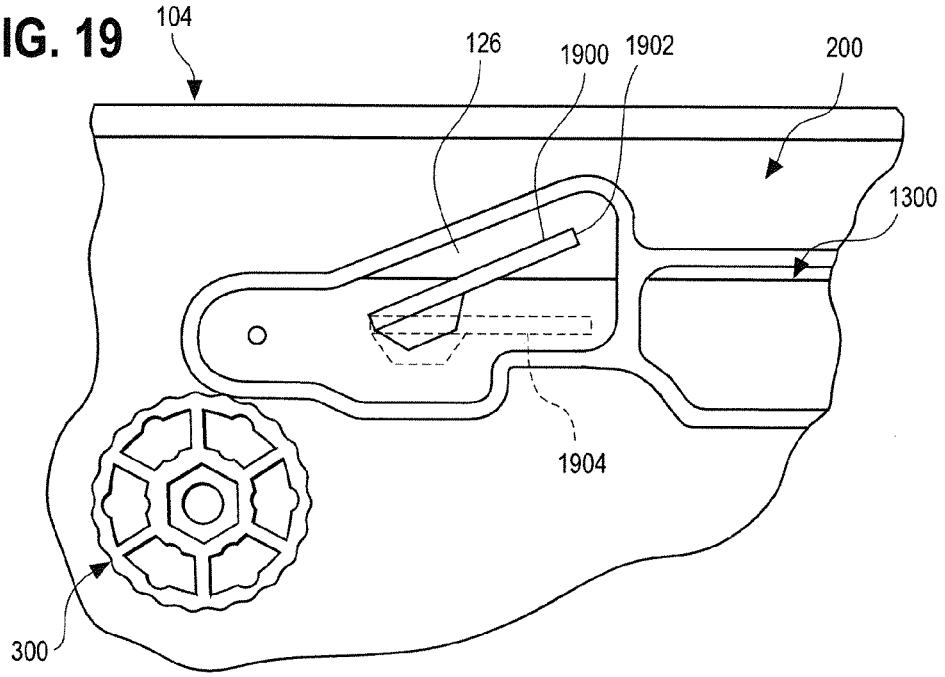
FIG. 19 is a partial plan view of the firearm support apparatus with the firearm with the firearm secured to the firearm support apparatus.

Referring next to FIG. 19, a partial plan view of the firearm support apparatus 100, including the thumb safety 1900, when the firearm 1300 is coupled to the bottom face 200 of the firearm support apparatus 100, is shown. Shown are the barrel edge 104, the thumb safety cutout 126, the bottom face 200, the first moveable boss 300, the firearm 1300, the thumb safety 1900, the safe position 1902, and the fire position 1904.

As previously described in FIG. 1, the thumb safety cutout 126 is configured to provide clearance around the thumb safety 1900 of the firearm 1300 when the firearm 1300 is coupled to the firearm support apparatus 100. The thumb safety 1900, when in the fire position 1904, approximately aligns with the top of the barrel 1302. An end of the thumb safety 1900 proximate to the barrel edge 104 is rotated towards the barrel edge 104 into the safe position 1902. As shown in FIG. 19, the thumb safety cutout 126 is configured to clear the thumb safety 1900 in the fire position 1904, the safe position 1902, and all intermediate positions, and to provide access for the use to manipulate the thumb safety 1900 when the firearm 1300 is coupled to the firearm support apparatus 100.

While the invention herein disclosed has been described by means of specific embodiments, examples and applications thereof, numerous modifications and variations could be made thereto by those skilled in the art without departing from the scope of the invention set forth in the claims.

What is claimed is:

1. A firearm support apparatus for securing a firearm, comprising:

a support plate including a top face configured to conformingly receive the firearm a flat position, the support plate including a barrel edge proximate to a barrel of the firearm when the firearm is supported by the support plate, the support plate further including a first boss cutout, the first boss cutout configured in a generally oblong shape, and located proximate to a back strap of the firearm when the firearm is supported in the flat position, the support plate further including a second boss cutout, the second boss cutout configured in a generally oblong shape, the second boss cutout located proximate to a front strap of the firearm when the firearm is supported in the flat position;

at least four bottom legs coupled to a bottom face of the support plate;

a first moveable boss comprising a first top cylinder, the first top cylinder including a first top circular hole parallel to a cylindrical axis of the first top cylinder, and a first top hexagonal indentation in an end of the first top cylinder distal to the support plate, the first top cylinder having an outer diameter greater than a width of the first boss cutout, and the first top cylinder cylindrical axis oriented generally perpendicular to the top face, a first bottom cylinder including a first bottom circular hole parallel to a cylindrical axis of the first bottom cylinder, and a first bottom hexagonal indentation in an end of the first bottom cylinder distal to the support plate, the first bottom cylinder having an outer diameter greater than the width of the first boss cutout, and the first bottom cylinder cylindrical axis oriented generally perpendicular to the bottom face, a first bolt comprising a first head and a first threaded shaft, whereby the first bolt couples the first top cylinder to the first bottom cylinder by the first head fitting snugly into the first top hexagonal indentation and the first threaded shaft extending through the first top circular hole, through the first boss cutout, and through the first bottom circular hole, a first nut fitting snugly into the first bottom hexagonal indentation and threadably coupled to the first threaded shaft, whereby the support plate is sandwiched between the first top cylinder and the first bottom cylinder and the first threaded shaft is encircled by the first boss cutout, whereby the first moveable boss slides relative to the top face and the bottom face by loosening the first nut and sliding the first moveable boss along the top face and the bottom face, and whereby the first moveable boss is frictionally coupled to the support plate by tightening the first nut on the first threaded shaft, and whereby the first moveable boss positionally engages the firearm when the firearm is supported in the flat position by the support plate and the first moveable boss is juxtaposed with a rear curved portion of the firearm, the rear curved portion proximate to the barrel;

a second moveable boss comprising a second top cylinder, the second top cylinder including a second top circular hole parallel to a cylindrical axis of the second top cylinder, and a second top hexagonal indentation in an end of the second top cylinder distal to the support plate, the second top cylinder having an outer diameter greater than a width of the second boss cutout, and the second top cylinder cylindrical axis oriented generally perpendicular to the top face, a second bottom cylinder including a second bottom circular hole parallel to a cylindrical axis of the second bottom cylinder, and a second bottom hexagonal indentation in the end of the first bottom cylinder distal to the support plate, the second bottom cylinder having an outer diameter greater than the width of the second boss cutout, and a second bottom cylinder cylindrical axis oriented generally perpendicular to the bottom face, a second bolt comprising a second head and a second threaded shaft, whereby the second bolt couples the second top cylinder to the second bottom cylinder by the second head fitting snugly into the second top cylinder hexagonal indentation and the second threaded shaft extending through the second top circular hole, through the second boss cutout, and through the second bottom circular hole, a second nut, the second nut fitting snugly into the second bottom hexagonal indentation and being threadably coupled to the second threaded shaft, whereby the support plate is sandwiched between the second top cylinder and the second bottom cylinder and the second threaded shaft is encircled by the second boss cutout, whereby the second moveable boss slides relative to the top face and the bottom face by loosening the second nut and sliding the second moveable boss along the top face and the bottom face, and whereby the second moveable boss is frictionally coupled to the support plate by tightening the second nut on the second threaded shaft; and whereby the second moveable boss positionally engages the firearm when the firearm is supported in the flat position by the support plate and the second moveable boss is juxtaposed with a front curved portion of the firearm, the front curved portion formed by an intersection of a trigger of the firearm and the front strap of the firearm;

at least one top frame projection coupled to the top face, the at least one top frame projection located proximate to the barrel edge, whereby the at least one top frame projection is juxtaposed with a top side of a firearm barrel, whereby a combination of the first moveable boss, the second moveable boss, and the at least one top frame projection results in horizontal restraint of the firearm, and whereby the horizontal restraint is removed by loosening at least one moveable boss.

2. The firearm support apparatus of claim 1, further comprising a generally tubular bottom projection coupled to the bottom face of the support plate generally proximate to a center of the barrel edge, a bottom projection length being less than or equal to the length of each of a plurality of bottom legs.

3. The firearm support apparatus of claim 1, further comprising:

the bottom face of the support plate configured to support the firearm in the flat position when the bottom face faces upward;

at least four top legs coupled to the top face of the support plate, whereby the at least four top legs support the support plate when the bottom face faces upward;

at least one bottom frame projection coupled to the bottom face, the at least one bottom frame projection located proximate to the barrel edge, whereby the at least one bottom frame projection is juxtaposed with a top side of the firearm barrel, whereby the combination of the first moveable boss, the second moveable boss, and the at least one bottom frame projection results in horizontal restraint of the firearm when the bottom face faces upward, and whereby the horizontal restraint is removed by loosening the at least one moveable boss.

4. The firearm support apparatus of claim 3, further comprising a generally tubular top projection coupled to the top face of the support plate generally proximate to a center of the barrel edge, a top projection length less than or equal to the length of each of a plurality of top legs.

5. The firearm support apparatus of claim 1, the support plate further including a thumb safety cutout configured such that a thumb safety of the firearm is uncontacted by the firearm support apparatus when the firearm is secured in the flat position on the support plate.

6. The firearm support apparatus of claim 1, further comprising a generally tubular top striker holder coupled to the top face in a location accessible when the firearm is secured in the flat position by the firearm support apparatus, a top striker holder configured to receive an end of a firearm striker, whereby a striker spring is accessible when a striker is received by the top striker holder.

7. The firearm support apparatus of claim 3, further comprising a generally tubular bottom striker holder coupled to the bottom face in a location accessible when the firearm is secured in the flat position by the firearm support apparatus and the bottom face faces upward, the bottom striker holder configured to receive an end of a firearm striker, whereby a striker spring is accessible when a striker is received by the bottom striker holder.

8. The firearm support apparatus of claim 1, the support plate further including a takedown lever cutout, the takedown lever cutout configured such that a frame takedown lever of the firearm is uncontacted by the firearm support apparatus when the firearm is secured in the flat position on the support plate.

9. The firearm support apparatus of claim 1, wherein the top face of the support plate includes a takedown lever contour configured such that a takedown lever is uncontacted by the support plate when the firearm is supported in the flat position.

10. The firearm support apparatus of claim 3, wherein the top face of the support plate includes a takedown lever contour configured such that a takedown lever is uncontacted by the support plate when the bottom face faces upward and the firearm is supported in the flat position.

11. The firearm support apparatus of claim 1, the support plate further including a slide lock lever cutout configured such that a slide lock lever of the firearm is uncontacted by the firearm support apparatus when the firearm is secured in the flat position on the support plate.

12. The firearm support apparatus of claim 1, the support plate further including a magazine release lever cutout configured such that a magazine release lever of the firearm is uncontacted by the firearm support apparatus when the firearm is secured in the flat position on the support plate.

13. The firearm support apparatus of claim 1, the support plate further including a sear housing pin cutout configured whereby a sear housing pin may be removed from the firearm and pass through the sear housing pin cutout when the firearm is secured in the flat position on the support plate.

14. The firearm support apparatus of claim 1, further comprising a top trigger holder including at least one top trigger holder wall, the at least one top trigger holder wall coupled to the top face of the support plate, the at least one top trigger holder wall configured to receive the trigger of the firearm.

15. The firearm support apparatus of claim 14, further comprising at least one trigger pin cutout located within a perimeter of the at least one top trigger holder wall, whereby a trigger pin may pass through the at least one trigger pin cutout when the trigger is received by the top trigger holder.

16. The firearm support apparatus of claim 15, further comprising a bottom trigger holder including at least one bottom trigger holder wall, the at least one bottom trigger holder wall coupled to the bottom face of the support plate, the at least one bottom trigger holder wall configured to receive the trigger of the firearm when the bottom face is upward.

17. The firearm support apparatus of claim 1, wherein the firearm support apparatus is formed by injection molding.

18. The firearm support apparatus of claim 1, wherein the firearm support plate, the first top cylinder, the first bottom cylinder, the second top cylinder and the second bottom cylinder comprise high-density polymer plastic.

19. The firearm support apparatus of claim 1, wherein the first bolt, the first nut, the second bolt and the second nut comprise stainless steel.

* * * * *